US012780578B2

(12) United States Patent
Morohashi et al.

(10) Patent No.: US 12,780,578 B2
(45) Date of Patent: Nov. 3, 2026

(54) SHEET FEEDING APPARATUS AND IMAGE FORMING APPARATUS

(71) Applicant: CANON KABUSHIKI KAISHA, Tokyo (JP)

(72) Inventors: Kazuya Morohashi, Shizuoka (JP); Shutaro Kodama, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/740,797

(22) Filed: Jun. 12, 2024

(65) Prior Publication Data

US 2024/0417208 A1 Dec. 19, 2024

(30) Foreign Application Priority Data

Jun. 14, 2023 (JP) ..... 2023-097910
Jun. 23, 2023 (JP) ..... 2023-103597

(51) Int. Cl.

| | |
|---|---|
| ***B65H 7/02*** | (2006.01) |
| ***B65H 1/04*** | (2006.01) |
| ***B65H 1/26*** | (2006.01) |
| ***B65H 3/06*** | (2006.01) |
| ***B65H 7/14*** | (2006.01) |

(52) U.S. Cl.

CPC ..... *B65H 7/02* (2013.01); *B65H 1/04* (2013.01); *B65H 1/266* (2013.01); *B65H 3/0684* (2013.01); *B65H 7/14* (2013.01); *B65H 2511/51* (2013.01); *B65H 2511/515* (2013.01); *B65H 2601/324* (2013.01)

(58) Field of Classification Search

CPC ..... B65H 1/04; B65H 1/266; B65H 3/0684; B65H 3/66; B65H 3/68; B65H 7/02; B65H 7/04; B65H 7/14; B65H 2511/51; B65H 2511/515; B65H 2601/324

See application file for complete search history.

(56) References Cited

U.S. PATENT DOCUMENTS

| | | | | |
|---|---|---|---|---|
| 9,821,973 | B2 * | 11/2017 | Sato | G03G 15/6529 |
| 9,975,717 | B2 | 5/2018 | Fujinuma et al. | |
| 2017/0217707 | A1 * | 8/2017 | Fujinuma | B65H 1/266 |

(Continued)

FOREIGN PATENT DOCUMENTS

| | | | |
|---|---|---|---|
| JP | 2017007758 | A | 1/2017 |
| JP | 2017132600 | A | 8/2017 |
| JP | 2023076028 | A | 6/2023 |

*Primary Examiner* — Prasad V Gokhale

(74) *Attorney, Agent, or Firm* — ROSSI, KIMMS & McDOWELL LLP

(57) ABSTRACT

In a sheet feeding apparatus, a recording material is stacked in a stacking unit, a sheet surface detection member takes on one of a first state, in which the sheet surface detection member displaces according to a height of a top surface of the material, and a second state. A detector detects the sheet surface detection member. A feeding unit is mounted in and removed from a main body. The feeding unit includes a feed roller and a switching unit that switches the sheet surface detection member to one of the first state and the second state. The switching unit switches the sheet surface detection member to the second state in response to the feeding unit being replaced, and a controller detects that the feeding unit has been replaced based on a state change detected by the detector.

23 Claims, 20 Drawing Sheets

(56) References Cited

U.S. PATENT DOCUMENTS

| | | | | |
|---|---|---|---|---|
| 2018/0148283 | A1* | 5/2018 | Suzuki | G03G 21/1647 |
| 2023/0159291 | A1* | 5/2023 | Suzuki | G03G 15/6508<br>270/1.01 |

* cited by examiner

SHEET FEEDING APPARATUS AND IMAGE FORMING APPARATUS

BACKGROUND OF THE INVENTION

Field of the Invention

The present invention relates to a sheet feeding apparatus and an image forming apparatus having a sheet feeding apparatus, and particularly relates to a sheet feeding apparatus and an image forming apparatus for automatically detecting that a roller has been replaced when a roller unit for feeding a sheet is replaced.

Description of the Related Art

Image forming apparatuses such as printers, copiers, or the like have often been configured with a feeding unit that separates and feeds sheets held in a sheet stacking unit one at a time, a conveyance unit that conveys the sheets, a sheet discharge unit that discharges sheets on which images are recorded to a discharge port, and the like. In such units, rubber rollers are often used to feed the sheets.

To improve the sheet conveyance performance, materials which are soft, and therefore wear down easily, are used for rubber rollers, and the surface of the roller is therefore worn down as the roller is used. Rollers wearing down, paper dust produced by feeding sheets adhering to the rollers, and the like lead to a drop in the sheet conveyance performance, which in turn causes a drop in the printing quality. On the other hand, the lifespans of modern image forming apparatuses are increasing, and an increasing number of products are configured such that components related to printing performance, such as rollers, can be replaced by users, maintenance workers, and the like before the image forming apparatus reaches the end of its lifespan.

Japanese Patent Laid-Open No. 2017-007758 proposes a detection method by which an image forming apparatus detects the timing at which a feed roller is to be replaced. The time from when the feed roller starts rotating to when a sheet is conveyed to a sensor provided downstream in a conveyance path is measured, and conveyance delay in the sheet is detected based on the measured time. Then, when the rate of occurrence of the detected conveyance delay in the sheet exceeds a threshold, the image forming apparatus notifies a user or the like that it is necessary to replace the feed roller.

Japanese Patent Laid-Open No. 2017-132600 discloses a technique for detecting an erroneous operation when a feed roller is replaced by a user, a maintenance worker, or the like.

After a feed roller is replaced by a user, a maintenance worker, or the like, it is necessary to cause the image forming apparatus to recognize that the feed roller has been replaced with a new roller. It is therefore necessary for the user, the maintenance worker, or the like to perform a reset operation, such as making a setting indicating that the replacement of the feed roller in the image forming apparatus is complete, through an operation panel or the like of the image forming apparatus. The timing for replacing the roller is detected, for example, by calculating the total driving amount of the roller and determining whether that value has reached a predetermined value. The value indicating the total driving amount is then initialized through the reset operation. The driving amount may be calculated by using a counter to count the number of sheets conveyed by the roller, for example.

The reset operation described above is an operation performed by an operator (a worker) such as a user, a maintenance worker, or the like. As such, it is conceivable that after replacing the feed roller with a new roller, the operator may forget to perform the reset operation for setting the feed roller as having been replaced, confirm the operations, or the like. In such a case, because the reset operation has not been performed, the image forming apparatus will determine that the feed roller still needs to be replaced, and will continue to prompt the user, the maintenance worker, or the like to replace the feed roller.

Meanwhile, in an image forming apparatus having a plurality of sheet feed ports, it is conceivable that an operator may erroneously perform a reset operation for setting the feed roller as having been replaced for a sheet feed port in which the roller has not been replaced. As a result, the image forming apparatus will be unable to correctly detect the actual usage states of the feed rollers. It is therefore desirable for the image forming apparatus to be capable of automatically and correctly detecting that a feed roller has been replaced with a new roller, without relying on reset operations performed by a user, a maintenance worker, or the like.

Having been achieved in light of the above-described past examples, the present invention realizes a sheet feeding apparatus and an image forming apparatus capable of automatically detecting that a feed roller has been replaced with a new roller, and automatically executing a reset operation without requiring a manual operation.

SUMMARY OF THE INVENTION

To achieve this, according to one aspect of the present invention, there is provided a sheet feeding apparatus comprising: a stacking unit in which a sheet-shaped recording material is stacked; a sheet surface detection member capable of taking on one of a first state, in which the sheet surface detection member displaces in accordance with a height of a top surface of the recording material, and a second state; a detector configured to detect the sheet surface detection member; a feeding unit capable of being mounted in and removed from a main body of the sheet feeding apparatus, the feeding unit including a feed roller that conveys the recording material and a switching unit that switches the sheet surface detection member to one of the first state and the second state; and a controller, wherein the switching unit switches the sheet surface detection member to the second state in response to the feeding unit being replaced, and the controller is configured to detect that the feeding unit has been replaced based on a state change detected by the detector.

According to another aspect of the present invention, there is provided a sheet feeding apparatus comprising: a stacking unit in which a sheet-shaped recording material is stacked; a sheet surface detection member capable of taking on one of a first state, in which the sheet surface detection member displaces in accordance with a height of a top surface of the recording material, and a second state; a detector configured to detect the sheet surface detection member; a driving unit for being attached to and driving a removable feeding unit, the feeding unit including a feed roller that conveys the recording material and a switching unit that switches the sheet surface detection member to one of the first state and the second state; and a controller, wherein the switching unit switches the sheet surface detection member to the second state in response to the feeding unit being replaced, and the controller is configured to detect that the feeding unit has been replaced based on a state change detected by the detector.

According to still another aspect of the present invention, there is provided a sheet feeding apparatus comprising: a removable stacking unit in which a sheet-shaped recording material is stacked; a sheet feeding part detector configured to detect a state indicating whether the stacking unit is mounted or removed; a recording material detector configured to detect the recording material stacked in the stacking unit; a sheet surface detection member capable of taking on one of a first state, in which the sheet surface detection member displaces in accordance with a height of a top surface of the recording material, and a second state; a sheet surface detector configured to detect the sheet surface detection member; a feeding unit capable of being mounted in and removed from a main body of the sheet feeding apparatus, the feeding unit including a feed roller that conveys the recording material and a switching unit that switches the sheet surface detection member to one of the first state and the second state; and a controller, wherein the switching unit switches the sheet surface detection member to the second state in response to the feeding unit being replaced, and the controller is configured to detect that the feeding unit has been replaced based on history information indicating mounting and removal of the stacking unit detected by the sheet feeding part detector, when output of the sheet surface detector indicates that the recording material is at a height at which the recording material can be conveyed and output of the recording material detector indicates that the recording material is not present.

According to yet another aspect of the present invention, there is provided a sheet feeding apparatus comprising: a removable stacking unit in which a sheet-shaped recording material is stacked; a recording material detector configured to detect the recording material stacked in the stacking unit; a sheet surface detection member capable of taking on one of a first state, in which the sheet surface detection member displaces in accordance with a height of a top surface of the recording material, and a second state; a sheet surface detector configured to detect the sheet surface detection member; a feeding unit capable of being mounted in and removed from a main body of the sheet feeding apparatus, the feeding unit including a feed roller that conveys the recording material and a switching unit that switches the sheet surface detection member to one of the first state and the second state; and a controller, wherein the switching unit is configured to switch the sheet surface detection member to the second state in response to the feeding unit being replaced, and switch the sheet surface detection member from the second state to the first state in response to the feed roller being driven, and the controller is configured to drive the feed roller and switch the sheet surface detection member to the first state using the switching unit in response to a conveyance instruction, when the sheet surface detector detects that the recording material is at a height at which the recording material can be conveyed and the recording material detector detects that the recording material is present, and then, after the sheet surface detector detects that the recording material is not at a height at which the recording material can be conveyed, determine that the feeding unit has been replaced.

According to still another aspect of the present invention, there is provided a sheet feeding apparatus comprising: a removable stacking unit in which a sheet-shaped recording material is stacked; a sheet feeding detector configured to detect a state indicating whether the stacking unit is mounted or removed; a recording material detector configured to detect the recording material stacked in the stacking unit; a sheet surface detection member capable of taking on one of a first state, in which the sheet surface detection member displaces in accordance with a height of a top surface of the recording material, and a second state; a sheet surface detector configured to detect the sheet surface detection member; a feeding unit capable of being mounted in and removed from a main body of the sheet feeding apparatus, the feeding unit including a feed roller that conveys the recording material and a switching unit that switches the sheet surface detection member to one of the first state and the second state; and a controller, wherein the switching unit switches the sheet surface detection member to the second state in response to the feeding unit being replaced, the controller is configured to, when the sheet feeding part detector detects that the stacking unit has been removed, start measuring a time in response to the sheet surface detector detecting that a state of the recording material has changed from a height at which the recording material cannot be conveyed to a height at which the recording material can be conveyed, and stop measuring the time in response to the recording material detector detecting that a state in which the recording material is not present has changed to a state in which the recording material is present, and determine that the feeding unit has been replaced when the measured time is not less than or equal to a threshold time.

Further features of the present invention will become apparent from the following description of exemplary embodiments (with reference to the attached drawings).

DESCRIPTION OF THE EMBODIMENTS

Figure 1:
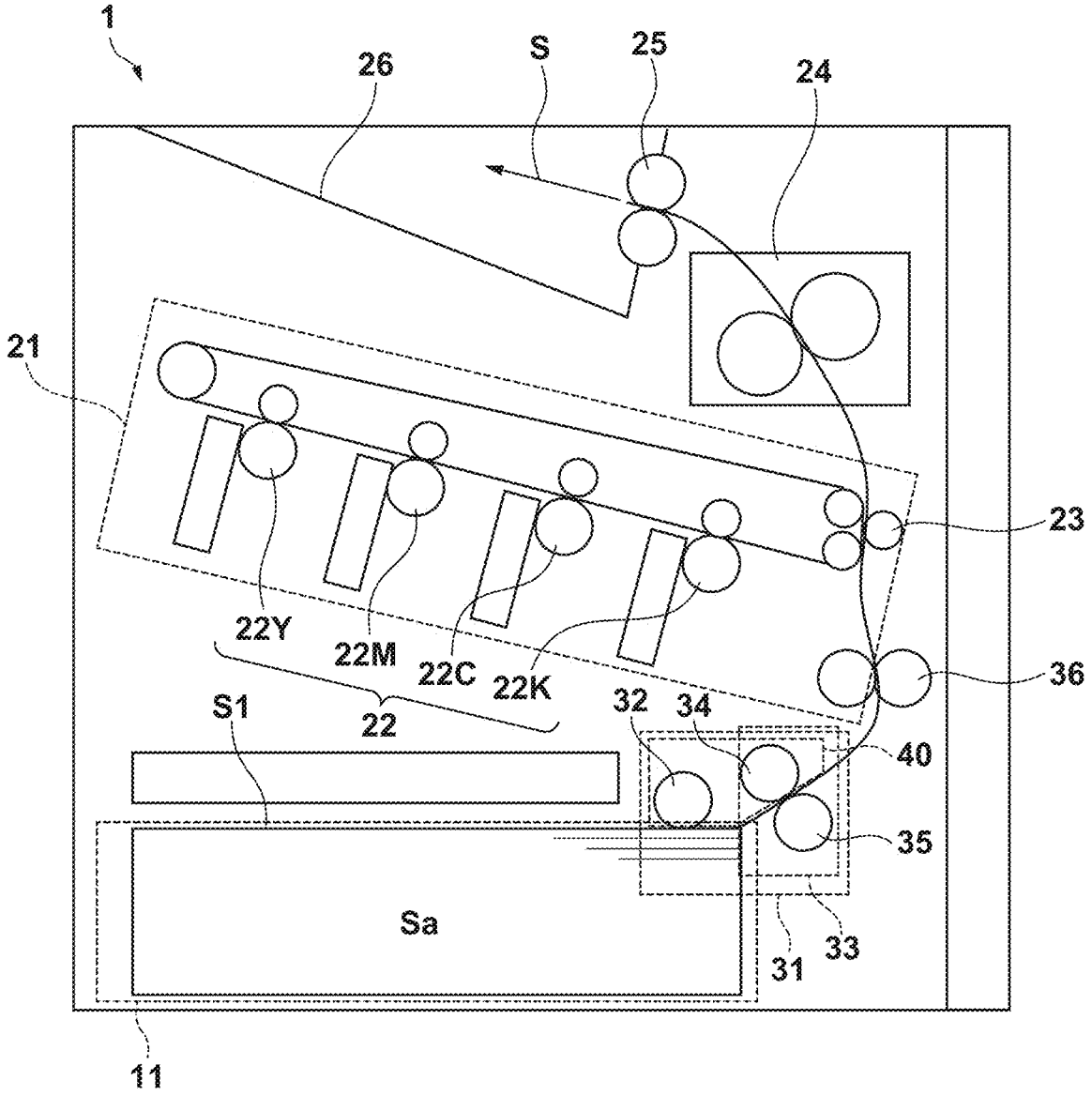
FIG. 1 is a front schematic cross-sectional view illustrating the overall configuration of an image forming apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

A first embodiment of the present invention will be described in detail hereinafter with reference to the drawings. In particular, an image forming apparatus, and a sheet feeding apparatus which feeds cut sheets, which are a sheet-shaped recording material, from a sheet feed cassette, and which is included in the image forming apparatus, will be described. FIG. 1 is a front cross-sectional view illustrating the overall configuration of a laser beam printer (LBP) serving as an example of the image forming apparatus according to the present embodiment. In an image forming system illustrated in FIG. 1, a sheet feed cassette 11, in which a sheet bundle Sa is stacked, is set in a lower part of an LBP main body 1.

A sheet feeding section 31 includes a pickup roller 32, which feeds out an uppermost sheet S1 of the sheet bundle Sa stacked in the sheet feed cassette 11 serving as a stacked means, and a separation roller pair 33 which separates the sheet S fed out by the pickup roller 32. The separation roller pair 33 is constituted by a feed roller 34 and a retard roller 35. Furthermore, a conveyance roller 36 is provided to convey the sheets S, which are separated and fed one at a time from the sheet bundle Sa by the separation roller pair 33, to an image forming section 21. The pickup roller 32 and the feed roller 34 are included in a feeding unit 40 which can be removed from the apparatus main body, and when components such as the pickup roller 32 are worn out, the feeding unit 40 as a whole is replaced. The pickup roller 32 and the feed roller 34 may be called "feed rollers" individually or collectively.

The image forming section 21 is a unit that forms images using an electrophotographic method. The image forming section 21 includes a photosensitive drum 22 that forms a toner image, a transfer roller 23 that transfers the toner image formed on the photosensitive drum 22 onto a sheet S fed from the sheet feed cassette 11, and the like. A fixing unit 24 is provided downstream from the image forming section 21, which fixes the toner image onto the sheet S by applying heat and pressure to the sheet S onto which the toner image has been transferred, thereby forming an image. To form a full-color image, the LBP 1 includes, as photosensitive drums 22, photosensitive drums 22Y, 22M, 22C, and 22K, which form toner images of yellow, magenta, cyan, and black color components, respectively.

The sheet S on which an image has been formed is discharged, by a sheet discharge roller 25, to a sheet discharge section 26 provided in an upper part of the apparatus.

Figure 2:
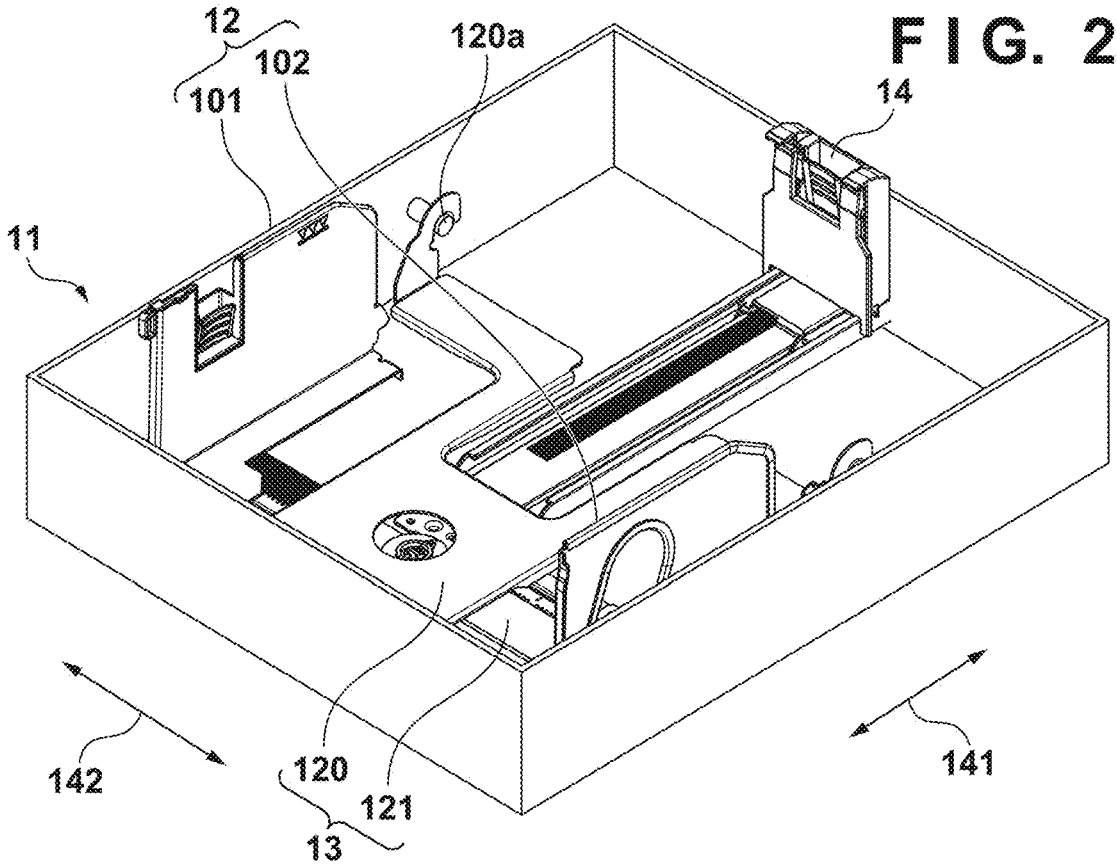
FIG. 2 is a diagram illustrating an overview of a sheet feed cassette.

FIG. 2 is a schematic diagram illustrating the configuration of the sheet feed cassette 11. The sheet feed cassette 11 includes a following end guide part 14, a side guide pair 12, and a lifter part 13. The following end guide part 14 is a guide part that regulates the position of the sheet S with respect to a feed direction 141 of the sheet. The side guide pair 12 includes a guide member 101 and a guide member 102, and is a guide pair that regulates the position of the sheet S with respect to a direction 142 orthogonal to the sheet feed direction 141. The lifter part 13 is configured to be stacked with the sheet bundle Sa and lift the sheet bundle Sa. The lifter part 13 is constituted by a middle plate 120 and a lift arm 121. The lift arm 121 rotates under a driving force from a driving motor (not shown). The middle plate 120 is disposed above the lift arm 121, and is pushed by the lift arm 121 to rotate about a middle plate rotation shaft 120*a* to lift the sheet bundle Sa stacked on the middle plate. As a result, the sheet bundle Sa is supported from below by the middle plate 120 so as to be inclined upward, with the side supported by the following end guide part 14 being the point of support.

Figure 3A:
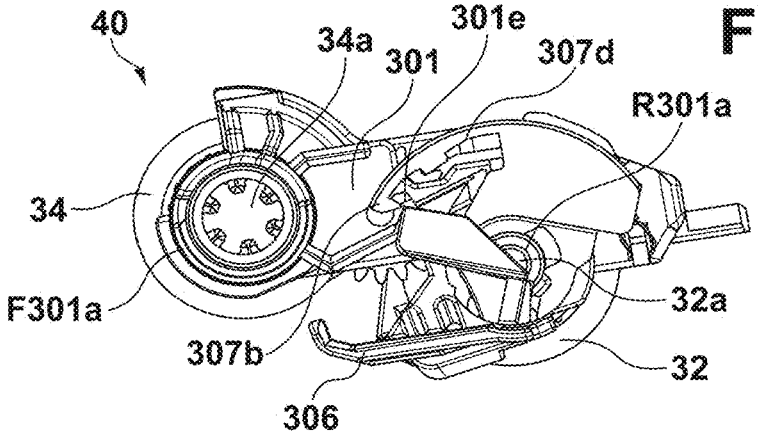
FIGS. 3A to 3D are diagrams illustrating the configuration of a feeding unit according to a first embodiment of the present invention.
Figure 5A:
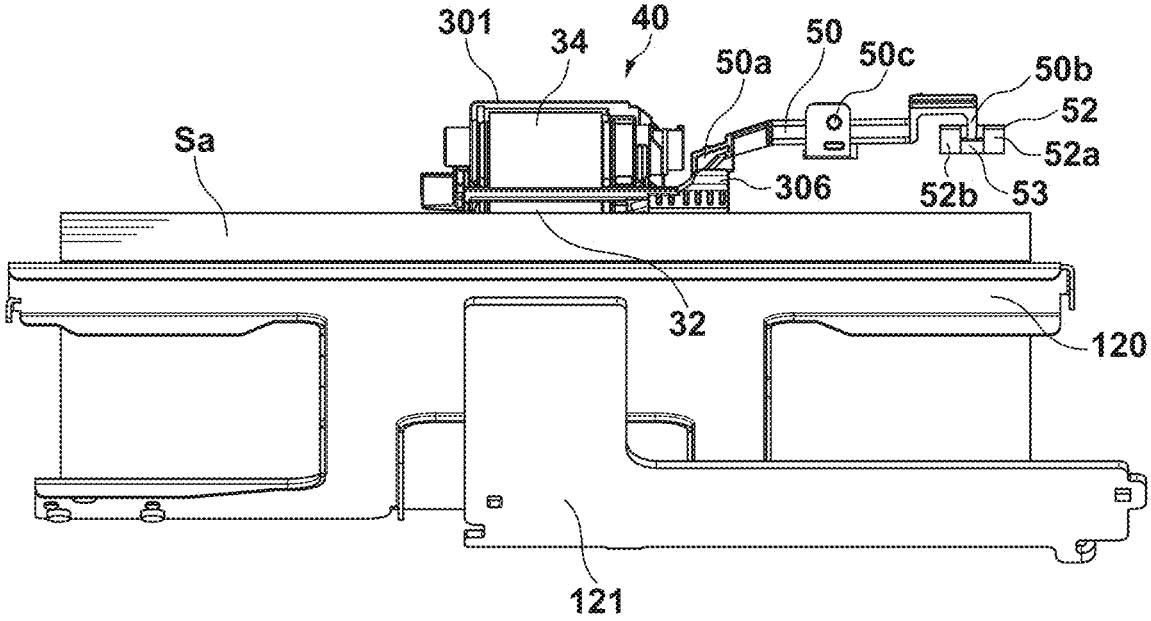
FIGS. 5A and 5B are diagrams illustrating a state in which a sheet can be fed by the feeding unit.
Figure 5B:
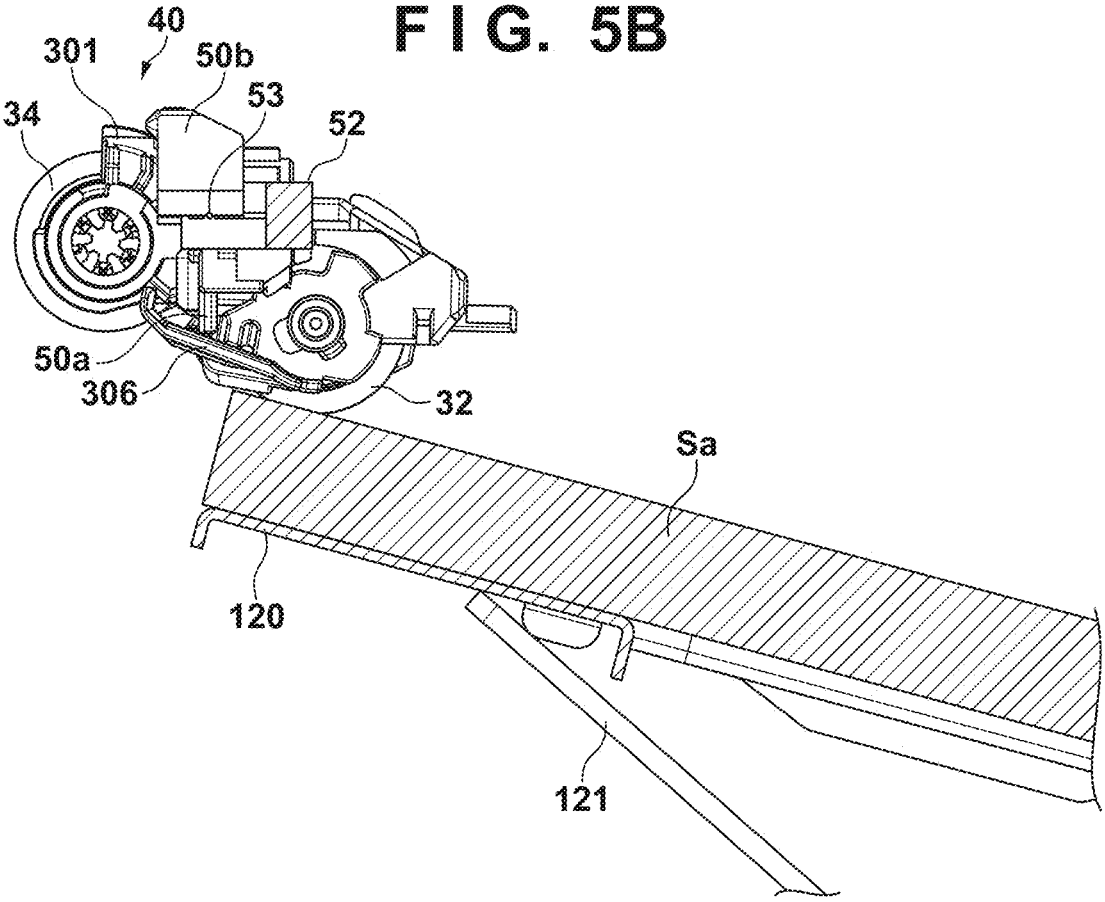

FIG. 5A is a diagram illustrating, from the front, a state in which the sheet bundle Sa is lifted by the middle plate 120, and FIG. 5B is a cross-sectional view of this state seen from the side. Here, the "front" is a plane in the conveyance direction of the sheet or the direction opposite thereto. A shaft for rotating the feed roller 34 is not illustrated in FIG. 5A. The feeding unit 40 is attached above the middle plate 120. The feeding unit 40 is a unit in which the pickup roller 32, the feed roller 34, and a sheet surface detection plate 306 are each rotatably attached to a feeding holder 301, which is illustrated in FIG. 3A. Although these elements are freely rotatable, the pickup roller 32 is configured to rotate under force from the feed roller 34 transmitted through a gear. As illustrated in FIGS. 5A and 5B, a sheet surface lever 50 serving as a sheet surface detection member, and a sheet surface sensor 52 serving as a detection member, are disposed in the LBP main body 1 to which the feeding unit 40 is attached.

The sheet surface lever 50 is configured including a detection end 50*a*, which is an end part on the feeding unit 40 side, a flag part 50*b*, which is an end part on the opposite side, and a rotation support point 50*c* in the center thereof. When in a freely-movable state, the sheet surface lever 50 may be biased about the rotation support point 50*c* in what is the counterclockwise direction in FIG. 5A (i.e., such that the detection end 50*a* is lowered and the flag part 50*b* is raised). If the center of gravity of the sheet surface lever 50 is positioned closer to the detection end 50*a* than the rotation support point 50*c*, no special mechanism for biasing is necessary. However, if such is not the case, the sheet surface lever 50 may be biased so as to rotate in the counterclockwise direction using a spring or the like. Through this configuration, the sheet surface lever 50, and the detection end 50*a* and the flag part 50*b* in particular, displace according to the height of the top surface of the sheet bundle.

The sheet surface sensor 52 is a photointerrupter including a light-emitting unit 52*a* that emits light 53 and a light-receiving unit 52*b* that receives the light 53 emitted from the light-emitting unit 52*a*, and is a light detection sensor. The sheet surface sensor 52 detects a light-blocking state in which the flag part 50*b* of the sheet surface lever blocks the light 53 from the light-emitting unit 52*a*, or a light-transmissive state in which the light 53 from the light-emitting unit 52*a* is not blocked. In the present embodiment, control is performed such that the light-transmissive state is determined to be a state in which the height of the top surface of the sheet bundle Sa is a height at which feeding is not possible, whereas the light-blocking state is determined to be a state in which the height of the top surface of the sheet bundle Sa is a height at which feeding is possible. However, the embodiment is not limited thereto. Control may be performed such that the light-transmissive state is determined to correspond to a height at which feeding is possible. In this manner, the states indicated by a light-blocking state and a non-light-blocking state can be switched. In the present embodiment, the light-blocking state may be called a "feed-capable state" or a "first state", and the non-light-blocking state (the light-transmissive state) may be called a "feed-incapable state" or a "second state".

As illustrated in FIG. 5B, the sheet bundle Sa is lifted by the middle plate 120 and makes contact with the sheet surface detection plate 306. The detection end 50*a* of the sheet surface lever makes contact with the sheet surface detection plate 306 while being biased by a biasing member (not shown). When the sheet surface detection plate 306 is pushed up by the sheet bundle Sa, the detection end 50*a* of the sheet surface lever is also pushed upward. Upon being pushed upward, the detection end 50*a* rotates about the rotation support point 50*c*, and the flag part 50*b* moves downward, i.e., is lowered. When the flag part 50*b* blocks the light of the sheet surface sensor 52, a height at which feeding is possible is determined to have been reached, and the raising of the middle plate 120 is stopped.

When the sheet bundle Sa is set in the sheet feed cassette 11, the pickup roller 32 contacts the uppermost sheet, as illustrated in FIG. 5B. When the feed roller 34 is driven in this state, the pickup roller 32 is driven in accordance therewith, and the uppermost sheet is fed toward the feed roller 34.

Configuration and Operations of Feeding Unit 40

The detailed configuration and operations of the feeding unit 40 according to the present invention will be described next in detail.

Figure 3B:
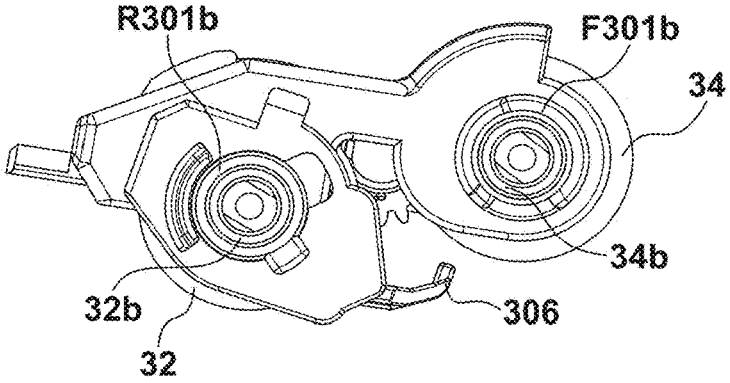

FIGS. 3A to 3D are diagrams illustrating the configuration of the feeding unit 40 in detail. FIG. 3A is a diagram illustrating the feeding unit 40 from the side, and FIG. 3B is a diagram illustrating the feeding unit 40 from the opposite side.

Figure 3C:
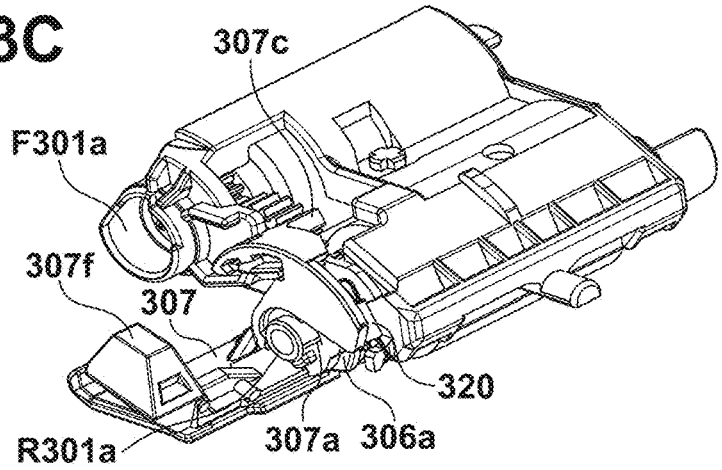
Figure 3D:
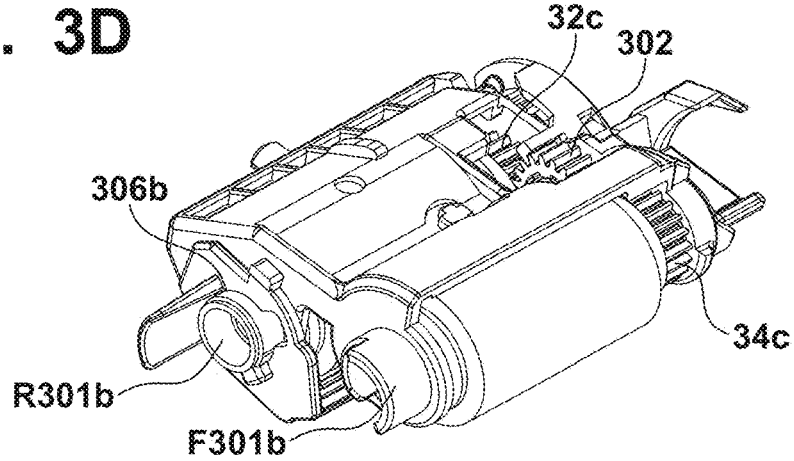

FIG. 3C is a perspective view of the side of the feeding unit 40 illustrated in FIG. 3A seen from the lower-left, and FIG. 3D is a perspective view of the side of the feeding unit 40 illustrated in FIG. 3B seen from the lower-left.

In addition to the feeding holder 301, feed roller 34, pickup roller 32, and sheet surface detection plate 306, the feeding unit 40 includes an idler gear 302, a holding member 307, and a biasing spring 320. The feeding holder 301 has hollow shaft pairs F301*a* and F301*b*, and R301*a* and R301*b*, which are opposite to each other and have a common axis line. The feed roller 34 has a shaft 34*a* and a shaft 34*b* at opposite ends. The outer surface of the shaft 34*a* and the inner surface of the hollow shaft F301*a*, and the outer surface of the shaft 34*b* and the inner surface of the hollow shaft F301*b*, are fitted to each other and attached so as to enable free rotation. Likewise, the pickup roller 32 has a shaft 32*a* and a shaft 32*b* at opposite ends. The outer surface of the shaft 32*a* and the inner surface of the hollow shaft F301*a*, and the outer surface of the shaft 32*b* and the inner surface of the hollow shaft F301*b*, are fitted to each other and attached so as to enable free rotation.

The one shaft 34*a* and the shaft 32*a* of the feed roller 34 and the pickup roller 32, respectively, have a gear part 34*c* and a gear part 32*c* in a part of the outer surfaces thereof, and each of the gear parts meshes with the idler gear 302. When the feed roller 34 is driven, the pickup roller 32 is driven via the idler gear 302. The sheet surface detection plate 306 has a hole 306*a* and a hole 306*b*, which engage with the outer surface of the shaft R301*a* and the outer surface of the shaft R301*b* of the feeding holder 301, respectively, and is attached so as to be freely rotatable about the shaft R301*a* and the shaft R301*b*.

The holding member 307 is attached so as to be freely rotatable by fitting a hole 307*a* thereof to the outer surface of the shaft R301*a* of the feeding holder. The biasing spring 320 illustrated in FIG. 3C connects the feeding holder 301 and the holding member 307, and biases the holding member 307 in what is the clockwise direction in FIG. 3A. The holding member 307 has a flexible arm 307*d*, and includes a hook part 307*b* at a tip of the arm 307*d* as well as a protruding part 307*c* in one surface of the arm 307*d*. The holding member 307 also includes a support part 307*f* that lifts a lifting surface 50*d* of the sheet surface lever 50 (described later).

The feeding holder 301 includes an engaging part 301*e* that engages with the hook part 307*b*, and can be engaged by rotating the holding member 307 in what is the counterclockwise direction in FIG. 3A against the force of the biasing spring 320. The protruding part 307*c* protrudes toward the side on which the idler gear 302 is disposed, and has a shape that meshes with the teeth of the idler gear 302.

Figure 4:
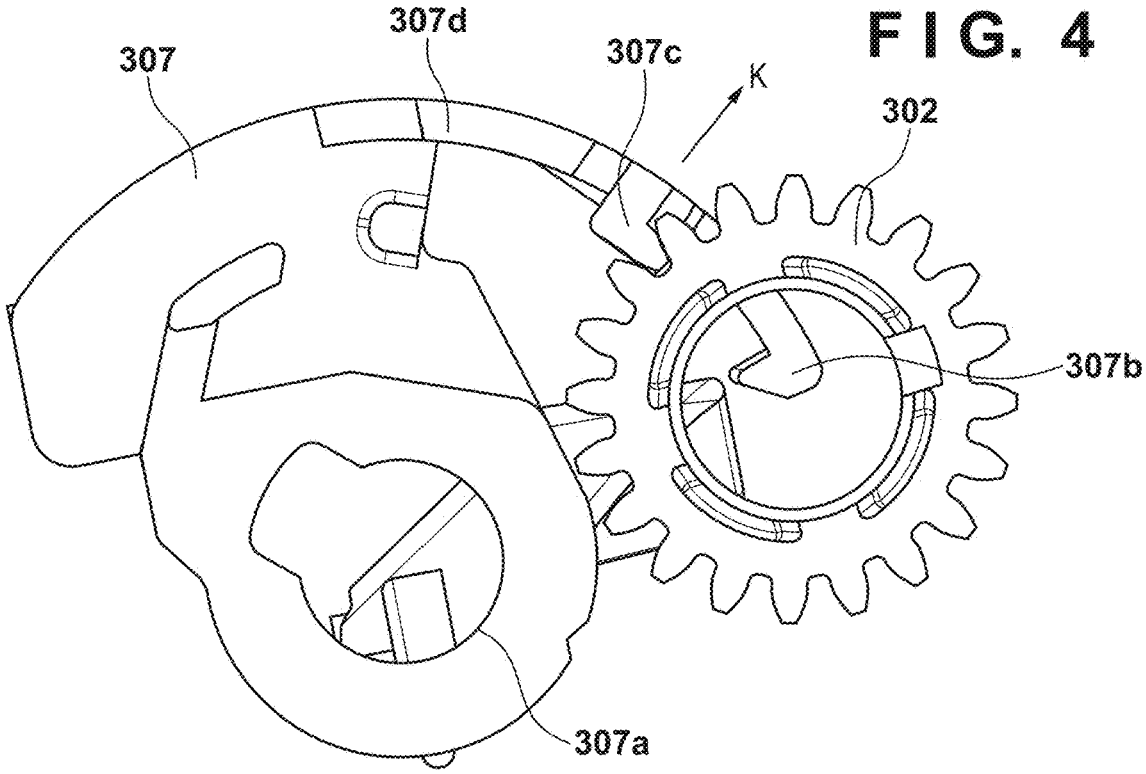
FIG. 4 is a diagram illustrating the principles of operation of a holding member according to the first embodiment of the present invention.

FIG. 4 illustrates a state in which the idler gear 302 and the protruding part 307*c* mesh with each other. When the feed roller 34 is driven, the idler gear 302 is rotated clockwise via the gear part 34*c*. When the idler gear 302 is rotated, the protruding part 307*c* that meshes with the teeth of the idler gear 302 is pushed up in the direction indicated by K, and the arm 307*d* connected thereto is also pushed up therewith.

Figure 6:
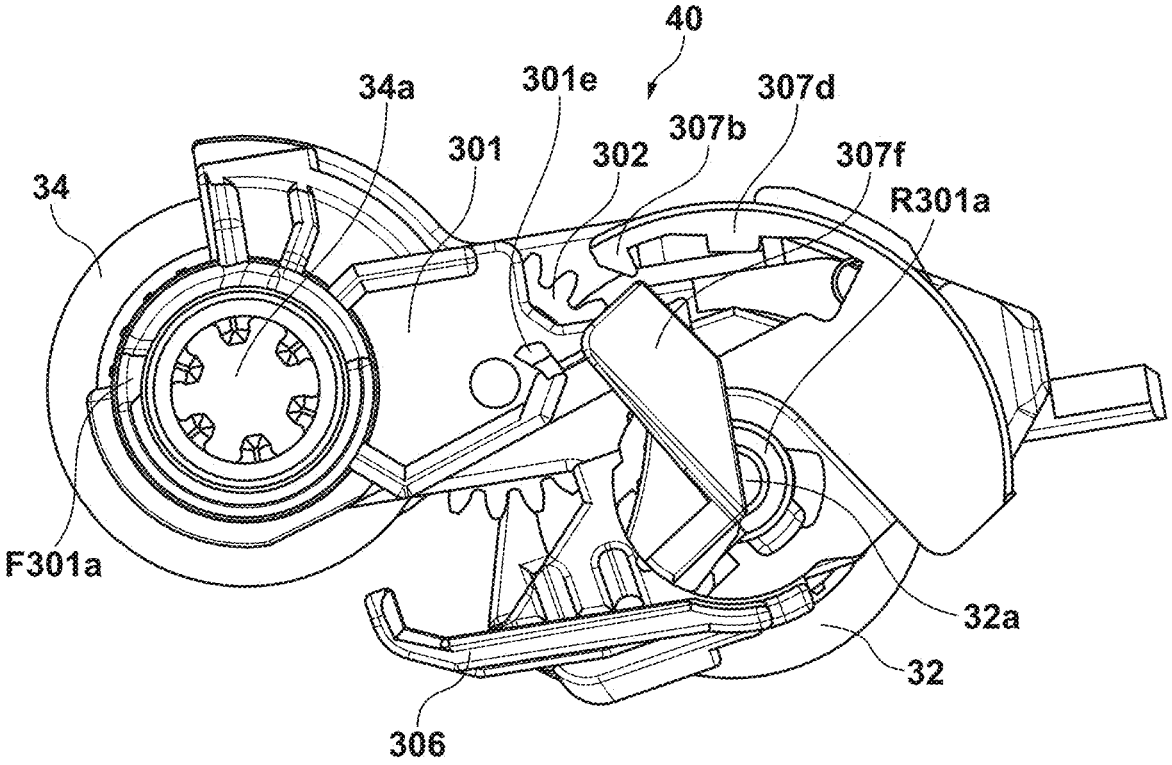
FIG. 6 is a diagram illustrating one form of the feeding unit according to the first embodiment of the present invention.

As the arm 307*d* is pushed up, the amount by which the hook part 307*b* hangs on the engaging part 301*e* decreases, and when the amount of hang reaches 0, the holding member 307 is rotated by the biasing force of the biasing spring 320. The rotation stops when the protruding part 307*c* collides with a part of the feeding holder 301, producing a state such as that illustrated in FIG. 6. As illustrated in FIG. 6, the hook part 307*b* disengages from the engaging part 301*e*, and the holding member 307 is rotated in the clockwise direction (which is the counterclockwise direction in FIG. 4) by the biasing force of the biasing spring 320. Note that in an unused state, it is desirable that a replacement feeding unit 40 be provided with the holding member 307 set to this operating position, as illustrated in FIG. 4.

Detecting Replacement of Feeding Unit 40

Figure 7A:
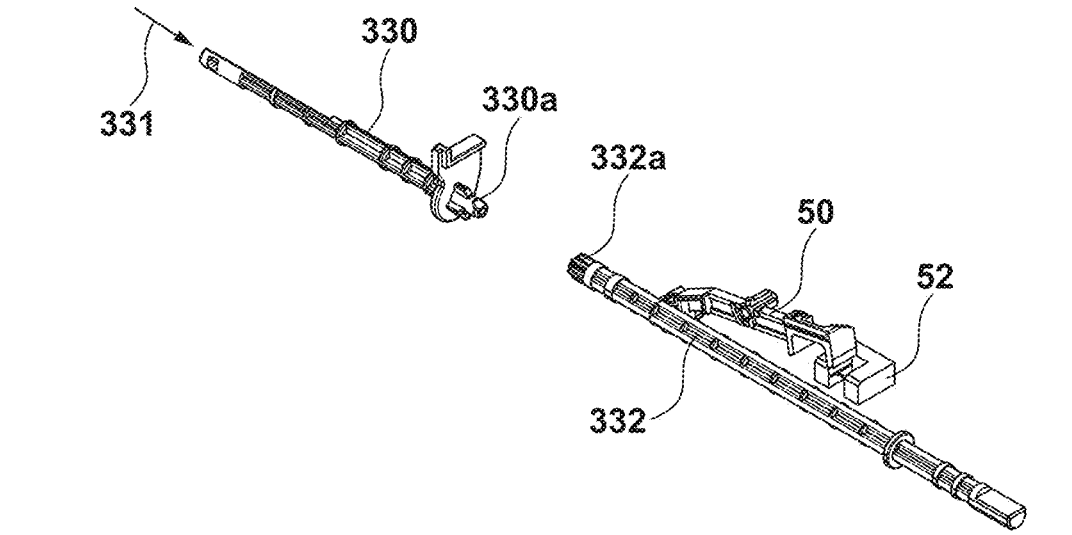
FIGS. 7A to 7C are diagrams illustrating attachment operations for the feeding unit according to the first embodiment of the present invention.
Figure 7B:
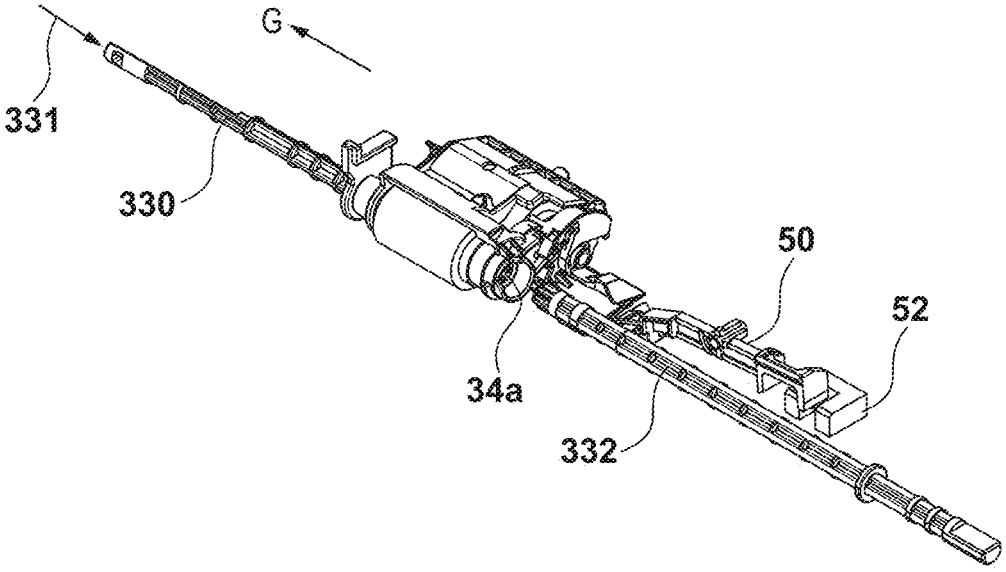
Figure 7C:
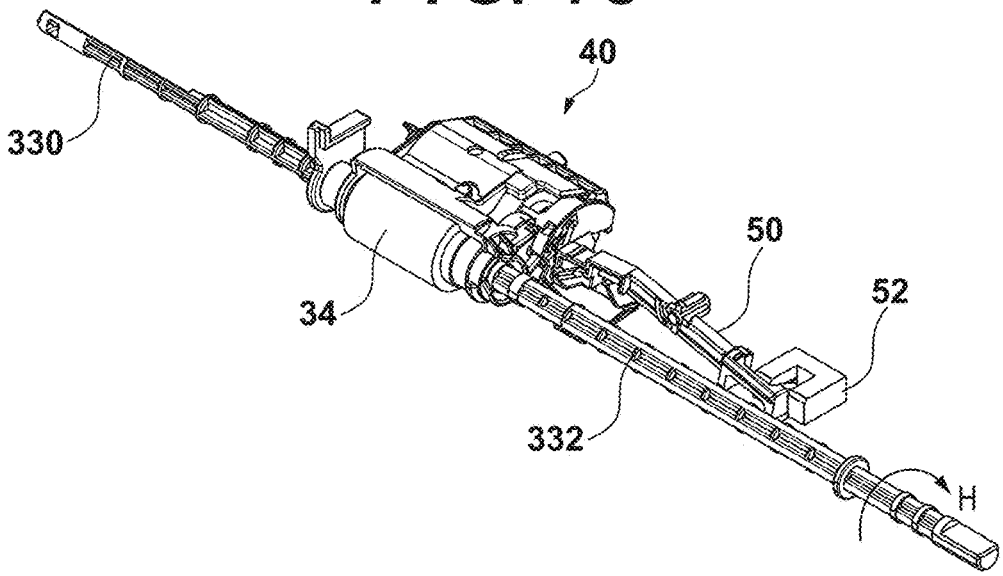

Operations for detecting the replacement of the feeding unit will be described next. FIG. 7A is a perspective view illustrating a mounting part of the feeding unit 40, and illustrates a state in which the feeding unit 40 has been removed. FIG. 7B illustrates a state in which the feeding unit 40 is partway through being mounted. A sliding shaft 330 is capable of moving in the direction indicated by G, and in a free state, is biased toward a feed shaft 332 side by a shaft pressurizing spring 331. A compression spring, a torsion spring, or the like can be used as the shaft pressurizing spring 331. The sliding shaft 330 is pushed in the direction indicated by G, and a tip 330*a* of the sliding shaft 330 is inserted into the shaft F301*b* of the feeding holder 301. The feeding unit 40 moves toward the feed shaft 332 side, and a tip 332*a* of the feed shaft 332 is inserted into an end 34*a* of the feed roller 34. The end 34*a* has a shape that meshes with the shape of the tip 332*a* of the feed shaft 332. FIG. 7C illustrates a state in which the feeding unit 40 has been mounted. In FIG. 7C, the end 34*a* is meshed with the tip 332*a* of the feed shaft 332. The feed shaft 332 is rotationally driven by a motor, for example. When the feed shaft 332 rotates in the direction indicated by H in the figure, the feed roller 34, which has the end 34*a* meshed with the feed shaft 332, also rotates in the direction indicated by H. The pickup roller 32 also rotates in accordance therewith.

When removing the feeding unit 40 from the sheet feed cassette 11, the opposite sequence from that described above is performed. First, from the state illustrated in FIG. 7C, the sliding shaft 330 is moved along with the feeding unit 40 in the direction indicated by G, which separates the feed shaft 332 from the feed roller (FIG. 7B). By then separating the feeding holder 301 from the sliding shaft 330, the feeding unit 40 can be removed, as illustrated in FIG. 7A.

Note that when the feeding unit 40 is to be replaced, the middle plate 120 is lowered in advance. This operation may be performed in response to an operator manipulating a switch or the like, for example. Alternatively, the image forming apparatus may be controlled such that when a door in a housing is opened in order to replace the feeding unit 40, a sensor or the like detects the door being opened, and the middle plate 120 is lowered in accordance with the detection result.

Figure 8A:
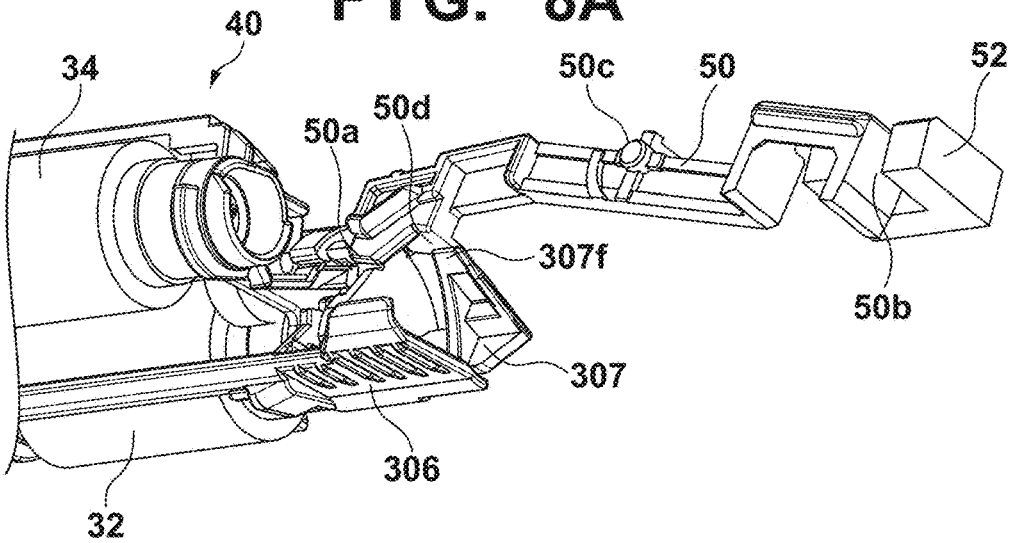
FIGS. 8A to 8C are diagrams illustrating a relationship between the holding member and a sheet surface detection member according to the first embodiment of the present invention.
Figure 8B:
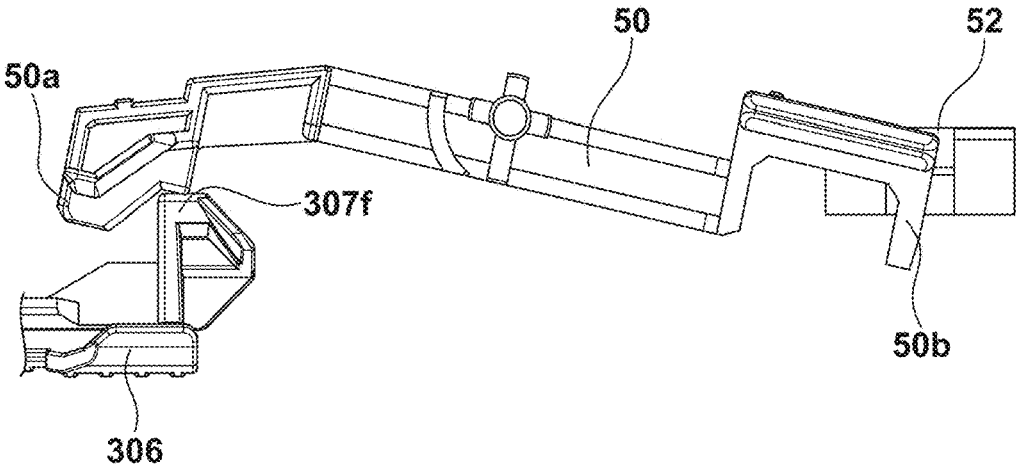
Figure 8C:
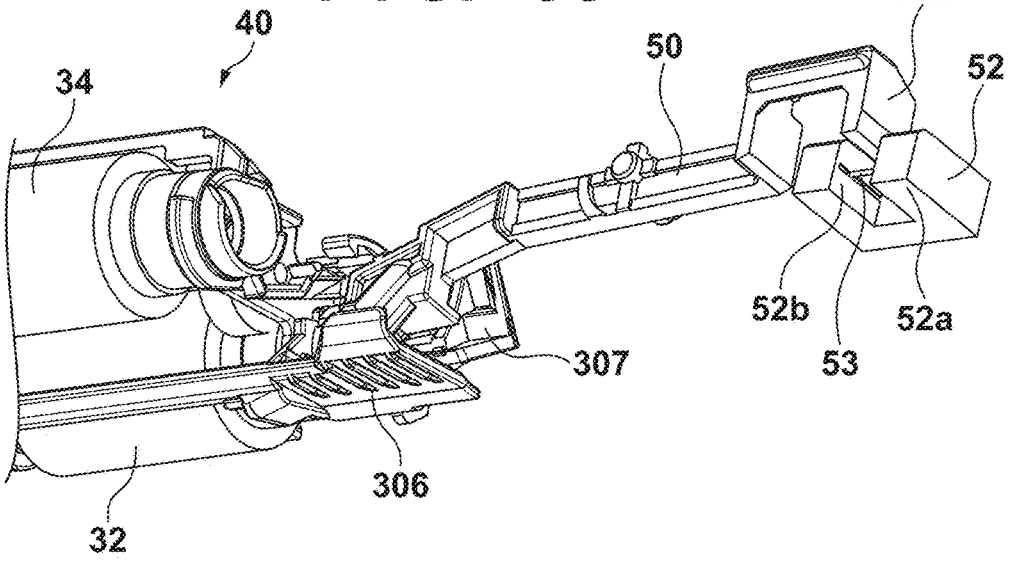

FIGS. 8A to 8C are enlarged views of the vicinity of the holding member 307, the sheet surface detection plate 306, the sheet surface lever 50, and the sheet surface sensor 52 in a state where the feeding unit 40 is mounted to the sliding shaft 330 and the feed shaft 332. FIGS. 8A and 8C are perspective views looking up at the feeding unit 40 from below, and FIG. 8B is a diagram of the sheet surface lever 50 and the like seen from the conveyance direction of the sheet. Note that the feed shaft 332 is not illustrated such that the feeding unit 40 and the sheet surface lever 50 are visible. In the state illustrated in FIG. 7C, where the feeding unit 40 is mounted, the support part 307*f* of the holding member 307 makes contact with the lifting surface 50*d* of the sheet surface lever 50 and is raised upward, as illustrated in FIG. 8A. At this time, as illustrated in FIG. 8B, the detection end 50*a* of the sheet surface lever 50 is lifted without making contact with the sheet surface detection plate 306, and the flag part 50*b* on the opposite end of the sheet surface lever 50 is positioned so as to continually block the light 53 from the sheet surface sensor 52. Note that if a replacement feeding unit 40 is provided in a state in which the protruding part 307*c* of the holding member 307 is set so as to mesh with the teeth of the idler gear 302 (an operating position), a worker only need perform the replacement task. However, when such is not the case, the worker may manually set the holding member 307 to the operating position.

Here, when the feed shaft 332 is rotated and the feed roller 34 is driven, the holding member 307 operates as described earlier with reference to FIGS. 4, 6, and the like.

FIG. 8C illustrates a state following the operation of the holding member 307. When the holding member 307 retracts rearward as indicated in the figure, the support part 307*f* of the holding member 307 separates from the lifting surface 50*d* of the sheet surface lever, and the detection end 50*a* of the sheet surface lever is in contact with the sheet surface detection plate 306. At this time, if the middle plate 120 is in a lowered state, the flag part 50*b* of the sheet surface lever 50 moves to a position where the light from the sheet surface sensor 52 is not blocked, and the height of the uppermost sheet S1 of the sheet bundle, lifted by the middle plate 120, can be detected.

The control unit provided in the image forming apparatus 1 determines that the roller (i.e., the feeding unit 40) has been replaced in response to the output of the sheet surface sensor 52 changing from the light-blocking state to the light-transmissive state after the roller has been driven. The first light-blocking state in this case is the state illustrated in FIGS. 8A and 8B, and the light-transmissive state after the feed roller is driven is the state illustrated in FIG. 8C. In the present embodiment, if the roller is determined to have been replaced, an operation is performed to reset a counter which counts the number of sheets that have passed to 0.

The control unit then rotates the lift arm 121, lifts the middle plate 120 and the sheet bundle Sa stacked thereon, and stops when the sheet surface sensor 52 senses that the state has changed to the light-blocking state again. In this state, the pickup roller 32 is in contact with the uppermost sheet S1. This completes preparations for the start of feeding of the uppermost sheet S1 from the sheet bundle Sa.

If the feeding unit 40 has not been replaced, the holding member 307 stays in the retracted position, rather than being in the operating position. Accordingly, the output of the sheet surface sensor 52 indicates the non-light-blocking state before and after the driving of the feed roller 34.

Thus, in the present embodiment, when the feeding unit 40 is replaced, the holding member 307 of the new feeding unit 40 is in the operating position, and the sheet surface sensor 52 is therefore in the light-blocking state. When the feed roller is driven thereafter, the holding member 307 moves to the retracted position, and the sheet surface sensor 52 enters the non-light-blocking state. The control unit determines that the feeding unit 40 has been replaced based on this state change, and resets the value of the counter that counts the conveyed number of sheets to 0. The lifter part 13 is then raised, and images can be formed.

Example of Control Configuration and Sequence

Figure 11:
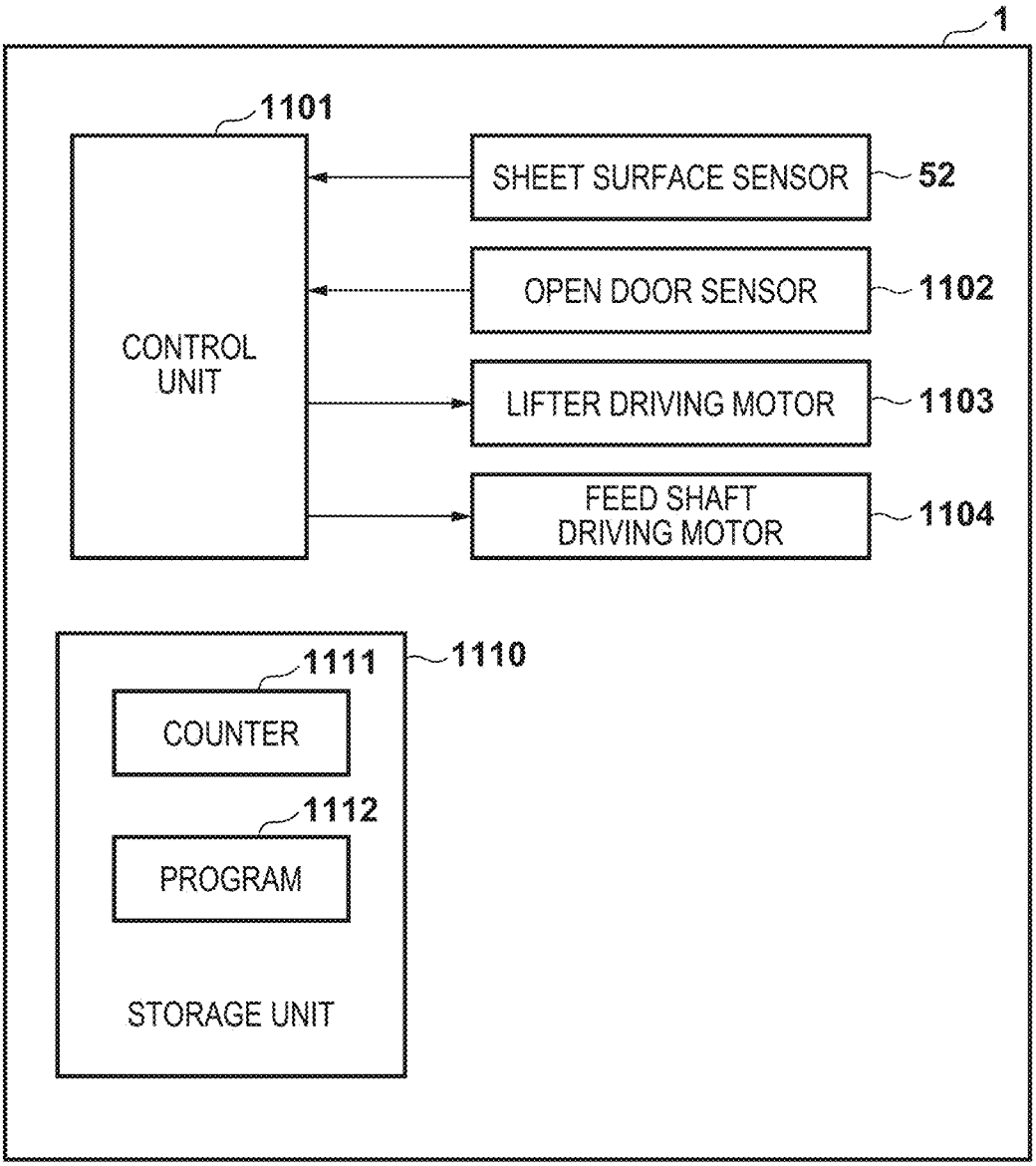
FIG. 11 is a diagram illustrating an example of a control configuration.
Figure 12:
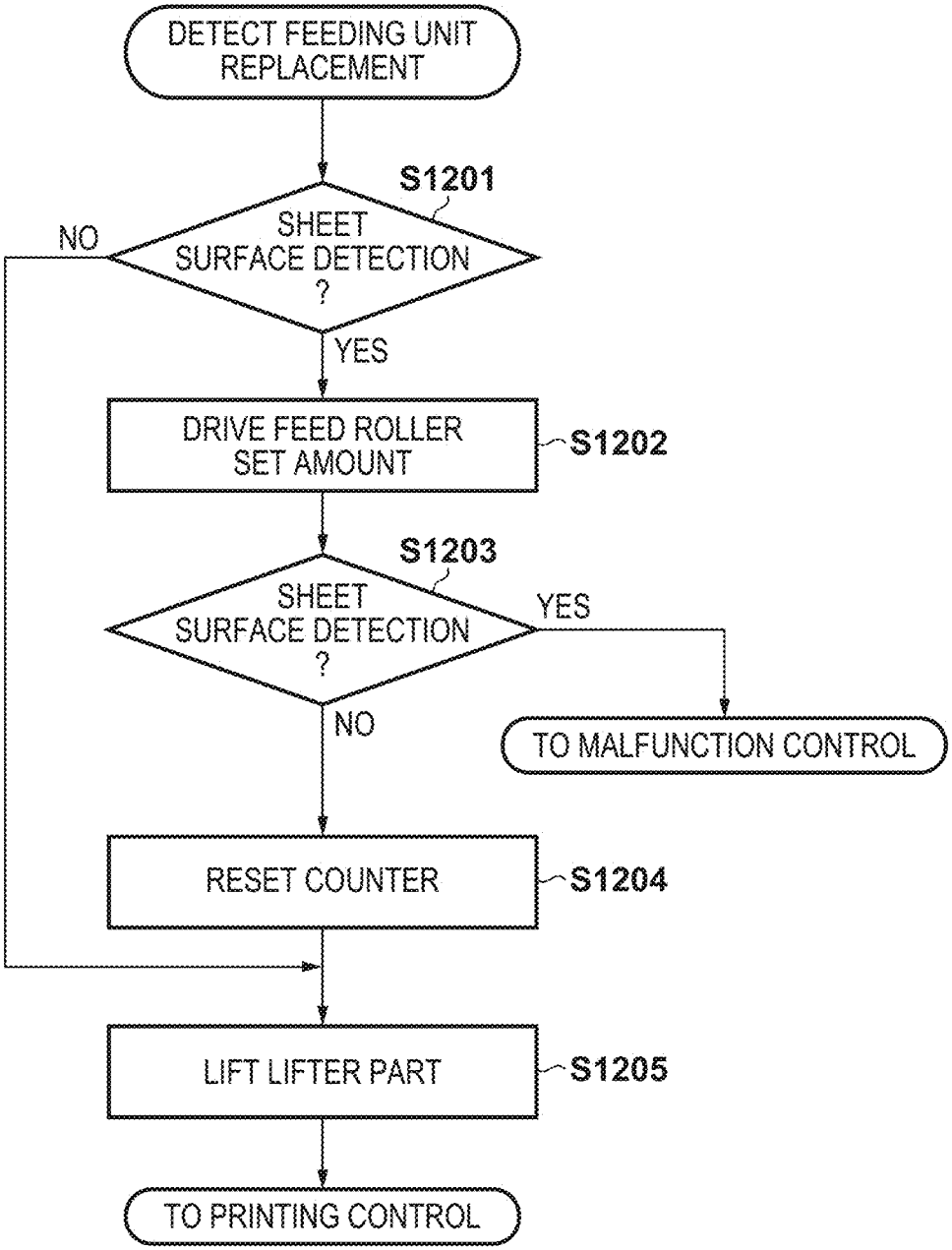
FIG. 12 is a diagram illustrating an example of a control sequence.

FIG. 11 illustrates an example of a configuration to achieve the foregoing, and FIG. 12 illustrates an example of a control sequence. In FIG. 11, a control unit 1101 controls the image forming apparatus 1 by executing a program 1112 stored in a storage unit 1110, for example. The control unit 1101 inputs a digitalized signal value from the sheet surface sensor 52, a signal value from an open door sensor 1102 indicating whether a door for maintenance is open or closed, or the like. The control unit 1101 also controls a lifter driving motor 1103 that drives the lifter part 13 upward and downward, a feed shaft driving motor 1104 that rotates the feed shaft in the sheet conveyance direction, and the like. The storage unit 1110 is provided with a region for a counter 1111, which, for example, increments its value by 1 each time a predetermined number of sheets (e.g., one) are fed from the sheet feed cassette 11.

The counter 1111 is checked periodically during the printing control sequence, or is checked as needed to see whether the value thereof exceeds a predetermined value. If the value thereof exceeds the predetermined value, a message indicating that the feeding unit 40 is to be replaced is output from a display unit, a speaker, or the like provided in the main body of the image forming apparatus 1. Alternatively, the message may be output to a host apparatus connected to the image forming apparatus 1.

FIG. 12 is a flowchart illustrating an example of a sequence for detecting that the feeding unit 40 has been replaced. The sequence illustrated in FIG. 12 is executed when the image forming apparatus 1 has entered a standby state, based on an instruction made by a worker, or based on a signal from the open door sensor 1102 indicating that the door is open, for example. "Standby state" in this example is a state in which printing can be started in response to a printing instruction, without requiring an operation by the worker. For example, the maintenance door may have been opened, and maintenance work performed, before the apparatus entered the standby state. During that time, the lifter part 13 is in a lowered state, and remains in the lowered state even when the sequence illustrated in FIG. 12 is started. The sequence illustrated in FIG. 12 is executed by the control unit 1101.

Upon returning to the standby state, first, the signal from the sheet surface sensor 52 is checked to determine whether the sheet surface has been detected (step S1201). If the sheet surface is not detected, i.e., if the sheet surface sensor 52 is in the non-light-blocking state, it is determined that the feeding unit 40 has not been replaced. The sequence branches to step S1205, where the lifter part 13 is raised in preparation for the subsequent printing control.

On the other hand, if in step S1201 the sheet surface is detected, i.e., the sheet surface sensor 52 is in the light-blocking state, the feed shaft driving motor 1104 drives by a set amount to feed a sheet in the conveyance direction (step S1202). The set amount may be any driving amount sufficient for the holding member 307 to move about the shaft from the operating position illustrated in FIG. 4 to the retracted position illustrated in FIG. 6. It is then determined again whether the sheet surface has been detected (step S1203). If the sheet surface has not been detected, i.e., if the sheet surface sensor 52 is in the non-light-blocking state, it is determined that the state illustrated in FIG. 8A has been detected in step S1201, and the state has shifted to that illustrated in FIG. 8C in response to the idler gear 302 rotating, which has then been detected. In other words, the feeding unit 40 is determined to have been replaced with a new component. Accordingly, the counter 1111 is reset and initialized to 0, for example (step S1204). The lifter part 13 is then raised until the sheet surface is detected (step S1205). Note that if the sheet surface is detected in step S1203, some kind of malfunction is determined to have occurred in the feeding unit 40 or the like, and an indication to that effect is output using a display, audio, or the like.

The replacement of the feeding unit 40 can be detected, and the counter can be reset, through the configuration and control described above. With this sequence, a worker does not need to reset the counter, and a manager or the like can therefore be notified of the timing for replacing the feeding unit immediately.

In the present embodiment, the counter which counts the number of sheets that have passed is reset as the operation performed after the roller replacement determination, but the configuration is not limited thereto. For example, a warning may be cleared, a notification may be issued to a user or a maintenance worker, or the like.

As described above, the present embodiment makes it possible to automatically detect that a feeding unit has been replaced.

Second Embodiment

Figure 9A:
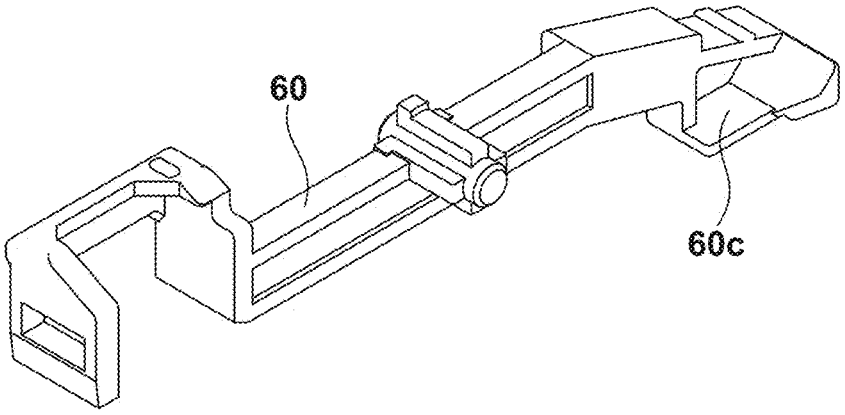
FIGS. 9A and 9B are diagrams illustrating the shape of a sheet surface detection member according to a second embodiment of the present invention.
Figure 9B:
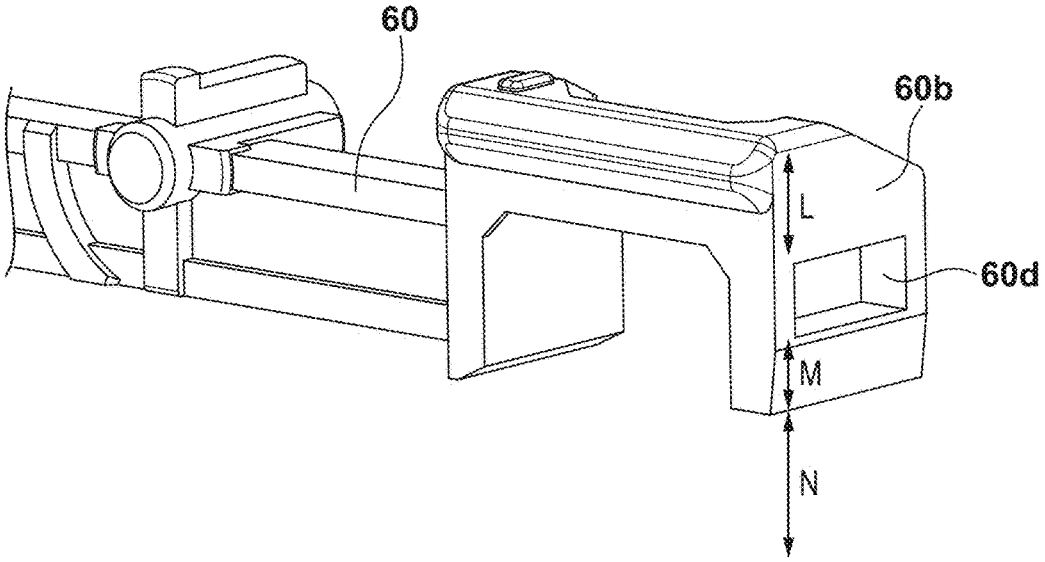

A second embodiment of the present invention will be described next. Parts that are the same as in the first embodiment will not be described here. FIGS. 9A and 9B illustrate the shape of a sheet surface lever 60 according to the present embodiment. Other components, configurations, and the like are similar to those of the first embodiment. Note that the feeding unit 40 being replaced may be referred to as "roller replacement" in the following descriptions.

The sheet surface lever 60 according to the present embodiment has a shape in which a slit 60*d* is provided in a part of a light-blocking surface 60*b* that blocks the light from the sheet surface sensor 52. The range indicated by "L" corresponds to an upper part of the light-blocking part, the range indicated by "M" corresponds to a lower part of the light-blocking part, and the range indicated by "N" is an area outside of the light-blocking part. The design is such that in a state in which a lifting surface 60*c* of the sheet surface lever 60 is lifted up by the support part 307*f* of the holding member 307, the range indicated by "L" is irradiated with the light 53 emitted from the light-emitting unit 52*a* of the sheet surface sensor 52. Furthermore, the design is such that in a state where the height of the uppermost sheet S1 of the sheet bundle Sa can be detected, the range indicated by "M" is irradiated with the light 53 from the sheet surface sensor 52 when the sheet bundle Sa is in an overloaded state, where the loading height of the sheet bundle Sa exceeds the permissible height for the sheet feed cassette 11. When the height of the uppermost sheet S1 is at a position lower than the height at which sheets can be conveyed by the pickup roller 32, the range indicated by "N" is irradiated with the light 53 from the sheet surface sensor 52.

When not in the overloaded state, the sheet bundle Sa is lifted by the middle plate 120 as a feed preparation operation. At this time, as the sheet bundle Sa rises, the irradiation position of the light 53 approaches the lower end of the range indicated by "M". The height when the light 53 changes from the light-transmissive state to the light-blocking state at the lower end of the range indicated by "M" is recognized as a height at which sheets can be fed, and the rising of the middle plate is stopped. On the other hand, when in the overloaded state, the range indicated by "M" is irradiated by the light 53 prior to the sheet bundle Sa being lifted by the middle plate 120. A determination sequence which uses a combination of the loading state of the sheet bundle Sa and whether or not the roller has been replaced will be described next.

When Roller is Replaced when not in Overloaded State

Because the roller is replaced, the range indicated by "L" is irradiated with the light 53 from the sheet surface sensor 52. Here, when the feed roller 34 is driven, the holding member 307 retracts. In response, the sheet surface lever 60 rotates in one direction within the operating range thereof, from the retracted position to a position where the range indicated by "N" is irradiated by the light 53 from the sheet surface sensor 52. The slit 60*d* is passed at this time, and thus the signal from the sheet surface sensor 52 switches three times, namely, from the light-blocking state, to the light-transmissive state, to the light-blocking state, and back to the light-transmissive state.

When such a signal change resulting from multiple changes between the light-blocking state and the light-transmissive state is detected, the control unit determines that the roller has been replaced and the loading state of the sheet bundle Sa is within a normal range. Accordingly, in this case, the counter 1111 is reset.

When Roller is Replaced when in Overloaded State

Similarly, because the roller is replaced, the range indicated by "L" is irradiated with the light 53 from the sheet surface sensor 52. The feed roller 34 is driven and the sheet surface lever 60 rotates, but because the state is the overloaded state, the rotation of the sheet surface lever 60 stops at a position where the range indicated by "M" is irradiated by the light 53 from the sheet surface sensor 52. At this time, the signal from the sheet surface sensor 52 switches twice, namely, from the light-blocking state, to the light-transmissive state, and back to the light-blocking state.

When such a signal change is detected, the control unit determines that the roller has been replaced and that the loading state of the sheet bundle Sa is the overloaded state, in which the sheet bundle exceeds the height at which sheets can be fed. Accordingly, in this case, the counter 1111 is reset. Furthermore, when the overloaded state is detected, the user is notified to that effect.

When Roller is not Replaced when in Overloaded State

Because the roller has not been replaced, a detection end 60*a* of the sheet surface lever 60 is in contact with the sheet surface detection plate 306. Additionally, because the sheet bundle Sa is in the overloaded state, the range indicated by "M" is irradiated by the light 53 from the sheet surface sensor 52. Even if the feed roller 34 is driven, the sheet surface lever 60 does not rotate and remains in place. At this time, the signal from the sheet surface sensor 52 does not change from the light-blocking state.

When such a signal is detected, the control unit determines that the roller has not been replaced, and the loading state of the sheet bundle Sa is the overloaded state. In this case, the user is notified that the overloaded state has been detected.

When Roller is not Replaced when not in Overloaded State

Because the roller has not been replaced and the state is not the overloaded state, the range indicated by "N" is irradiated by the light 53 from the sheet surface sensor 52. At this time, the control unit determines that the uppermost sheet S1 is at a position lower than the height at which sheets can be fed, and therefore rotates the lift arm 121 to lift the sheet bundle Sa. The rotation of the lift arm 121 is stopped once the sheet surface sensor 52 changes to the light-blocking state, which completes the preparations for starting the feeding of the sheet S1.

In the first embodiment, the position of the sheet surface lever 50 is stable both in the position indicated in FIG. 8A and the position indicated in FIG. 8C, and whether the sheet surface lever 50 is at that position can be determined through the sequence illustrated in FIG. 12. However, in the present embodiment, when the roller is replaced, the signal value of the sheet surface sensor 52 changes in a short period of time from when the sheet surface lever 60 moves from the state illustrated in FIG. 8A to the state illustrated in FIG. 8C. Accordingly, it may not be possible to ascertain transitions in the signal value even if the sheet surface detection is determined after driving the feed roller for a set amount as illustrated in FIG. 12. Accordingly, in the present embodiment, if the driving of the feed roller 34 has been started, the signal from the sheet surface sensor 52 is obtained repeatedly at a sufficiently short time interval until the driving ends. The "sufficiently short time interval" is a time interval at which the non-light-blocking state of the sheet surface sensor 52, arising due to the slit 60*d* when the sheet surface lever 50 moves from the operating position to the retracted position, and the light-blocking state of the sheet surface sensor 52, produced from the range of the light-blocking surface 60*b* indicated by "M", can be detected reliably. Doing so makes it possible to identify a transition in the signal value of the sheet surface sensor 52 described above.

As described above, according to the present embodiment, whether the roller has been replaced and whether the state is an overloaded state can both be determined using only the sheet surface lever 60 and the sheet surface sensor 52.

Third Embodiment

A third embodiment will be described next.

FIGS. 10A to 10D are schematic diagrams illustrating the feeding unit according to the present embodiment. The sheet surface sensor 52 illustrated in FIGS. 10A to 10D is illustrated with the side toward the viewer of the figure cut such that the position of the light 53 emitted from the light-emitting unit 52*a* can be seen easily. In the present embodiment, the configuration is such that a rotation flag 401 is attached to the feeding holder 301. Like the holding member 307 described in the first embodiment, the rotation flag 401 is attached so as to be freely rotatable by fitting a hole 401*a* with the outer surface of the shaft R301*a* of the feeding holder, with a biasing spring (not shown) biasing the rotation flag 401 in the clockwise direction. The configuration for holding rotation against the biasing spring, the mechanism by which a hook part 401*b* disengages in response to the idler gear 302 rotating and rotates in what is the clockwise direction in the figure, and the like are the same as those described in the first embodiment.

Figure 10A:
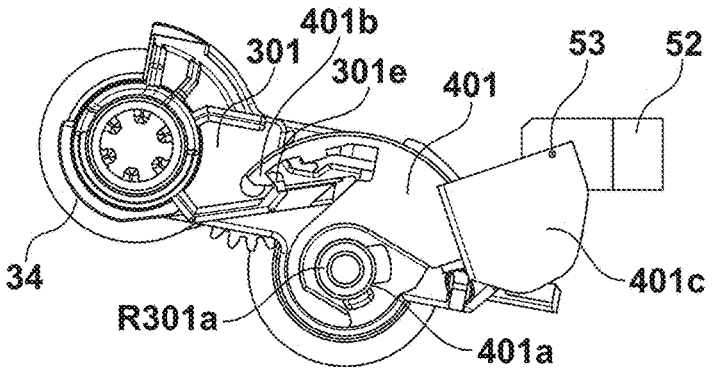
FIGS. 10A to 10D are diagrams illustrating the configuration and operations of a feeding unit according to a third embodiment of the present invention.
Figure 10B:
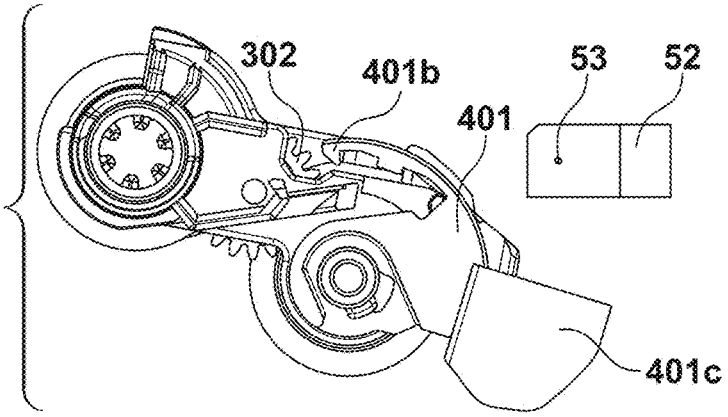

The rotation flag 401 includes a light-blocking part 401*c*, and is capable of switching the light 53 between the light-blocking state and the light-transmissive state. FIG. 10A illustrates a state prior to the feed roller 34 being driven. In this state, the light-blocking part 401*c* blocks the light 53 regardless of the angle of the feeding holder 301. Here, when the feed roller 34 is driven, the hook part 401*b* disengages and the rotation flag 401 rotates clockwise. Upon doing so, the light-blocking part 401*c* switches from the light-blocking state to the light-transmissive state, which enables the height of the uppermost sheet S1 to be detected, as illustrated in FIG. 10B. The change in the signal occurring at this time is sent to the control unit. In response to the sheet surface sensor 52 switching from the light-blocking state to the light-transmissive state after the feed roller 34 is driven, the control unit determines that the roller has been replaced, and resets the count of the number of sheets that have passed.

Figure 10C:
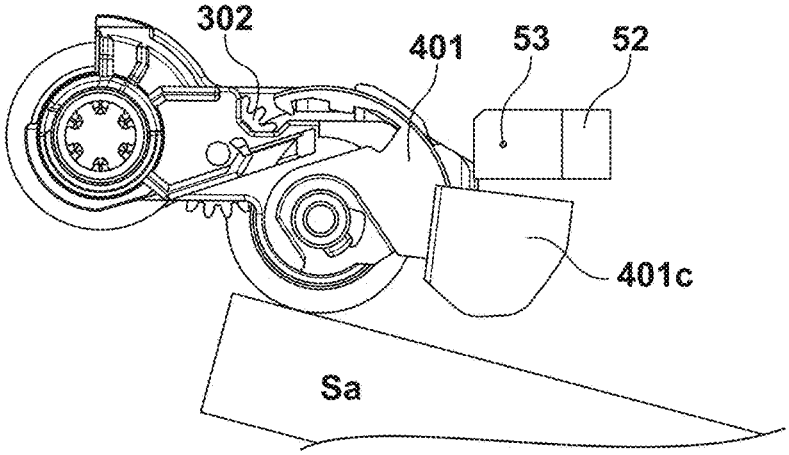
Figure 10D:
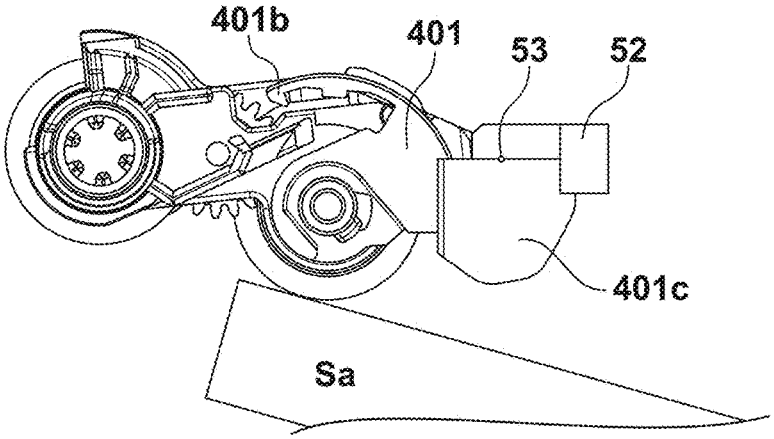

The sheet bundle Sa is then lifted by the middle plate (not shown). As illustrated in FIG. 10C, the sheet bundle Sa makes contact with the pickup roller 32 and pushes the pickup roller 32 upwards. The pickup roller 32 is pushed further upwards, and the light-blocking part 401*c* rises therewith, as illustrated in FIG. 10D. When the light-blocking part 401*c* blocks the light 53 again, the control unit determines that the height of the uppermost sheet S1 has reached the height at which sheets can be fed, and stops the lifting.

If the roller has not been replaced, the state is the state illustrated in FIG. 10B, as opposed to the state illustrated in FIG. 10A, at the point in time when the image forming apparatus 1 has entered the standby state. Accordingly, in the present embodiment, whether or not the roller has been replaced can be determined through a sequence similar to that illustrated in FIG. 12.

As described above, according to the present embodiment, the configuration is such that the flag which detects the height of the sheet surface also functions as a switching means, which makes it possible to automatically determine whether the roller has been replaced using fewer components.

Although the foregoing first to third embodiments have been described using a feeding unit of an LBP, the present invention is not limited thereto. The present invention can be similarly applied in an optional sheet conveyance apparatus or the like. Furthermore, the image forming apparatus is not limited to an electrophotographic apparatus, and the present invention can also be applied in an ink jet image forming apparatus and the like, for example.

Fourth Embodiment

Image Forming Apparatus

Figure 13:
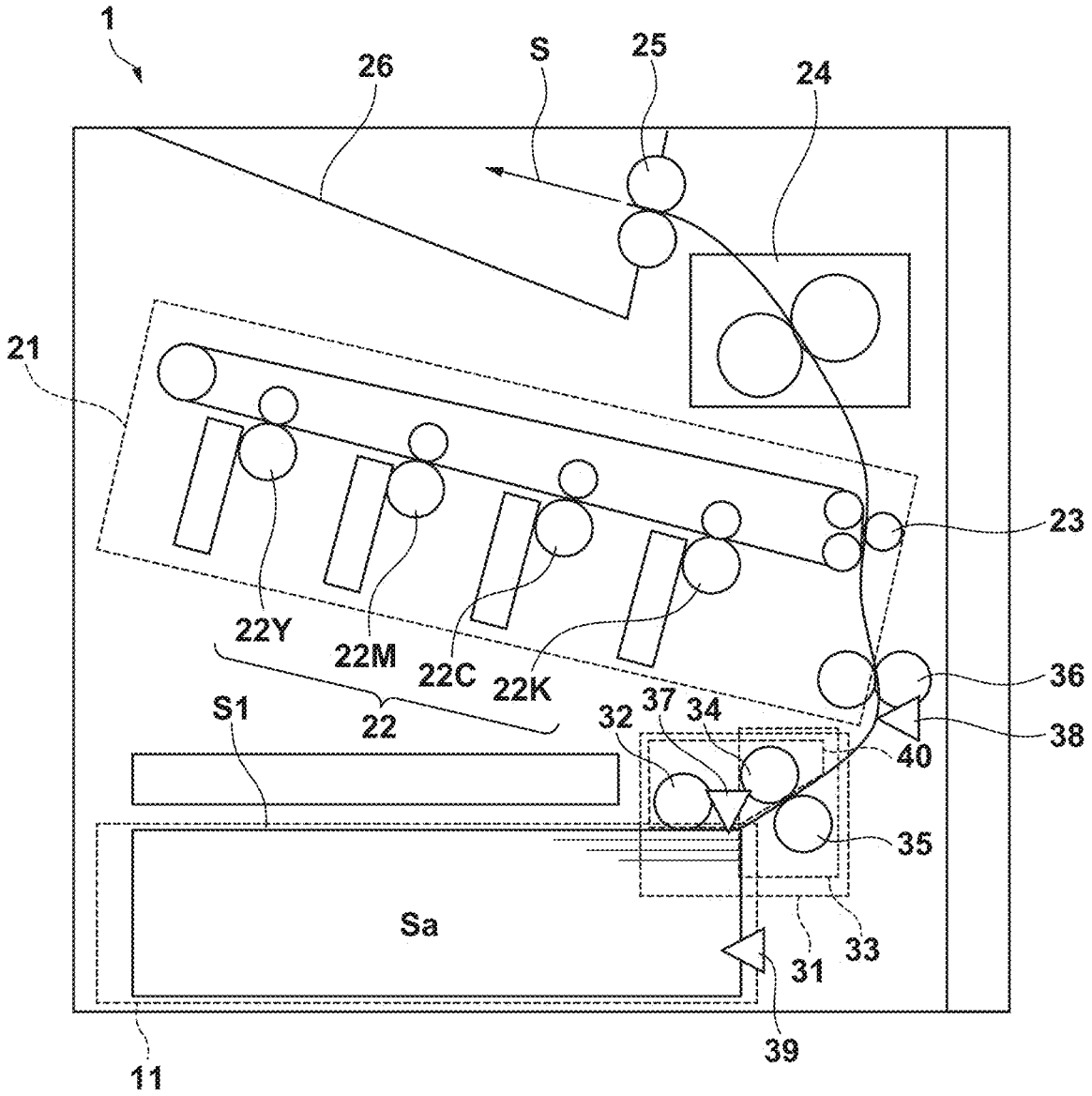
FIG. 13 is a front schematic cross-sectional view illustrating the overall configuration of an image forming apparatus.

A fourth embodiment of the present invention will be described in detail hereinafter with reference to the drawings. In particular, an image forming apparatus, and a sheet feeding apparatus which feeds cut sheets, which are a sheet-shaped recording material, from a sheet feed cassette, and which is included in the image forming apparatus, will be described. FIG. 13 is a front cross-sectional view illustrating the overall configuration of a laser beam printer (LBP) serving as an example of the image forming apparatus according to the present embodiment. The configuration illustrated in FIG. 13 is generally the same as that illustrated in FIG. 1, and thus only the differences from FIG. 1 will be described. With the exception of the differences, the configuration is the same as that illustrated in FIG. 1, and will therefore not be described. Additionally, in the present embodiment, the configurations illustrated in FIGS. 2 to 8C are the same as those in the first to third embodiments, and will therefore not be described.

In the image forming apparatus illustrated in FIG. 13, a sheet presence sensor 37, a conveyance sensor 38, and a cassette sensor 39 are provided in the vicinity of the sheet feed cassette 11. The sheet presence sensor 37 will also be called a "sheet detection sensor 37", and detects the presence or absence of a sheet stacked in the sheet feed cassette 11. The sheet presence sensor 37 is configured to detect the presence or absence of the sheet by, for example, emitting light onto the surface of the sheet and detecting light reflected thereby. The conveyance sensor 38 detects a sheet being conveyed. The sensor may be configured to detect reflected light from a small object such as a sheet, or a light source and a photosensor may be provided on opposite sides of the conveyance path to detect a sheet being conveyed. Alternatively, a mechanical switch may be used as the sensor. The cassette sensor 39 detects when, for example, a drawer-type sheet feed cassette 11 is pulled out or pushed in. Pulling out and pushing in the sheet feed cassette 11 will be referred to as "opening and closing the cassette". The cassette sensor 39 also detects the presence or absence of the sheet feed cassette 11. Alternatively, the cassette sensor 39 may be a sensor, provided in the main body of the image forming apparatus 1, that detects the opening and closing of a maintenance door for the sheet feed cassette 11, the feeding unit 40, or the like. In this case, too, the cassette sensor 39 also detects the presence or absence of the sheet feed cassette 11, but these detections may be made by individual sensors.

Hardware Block Diagram

Figure 14:
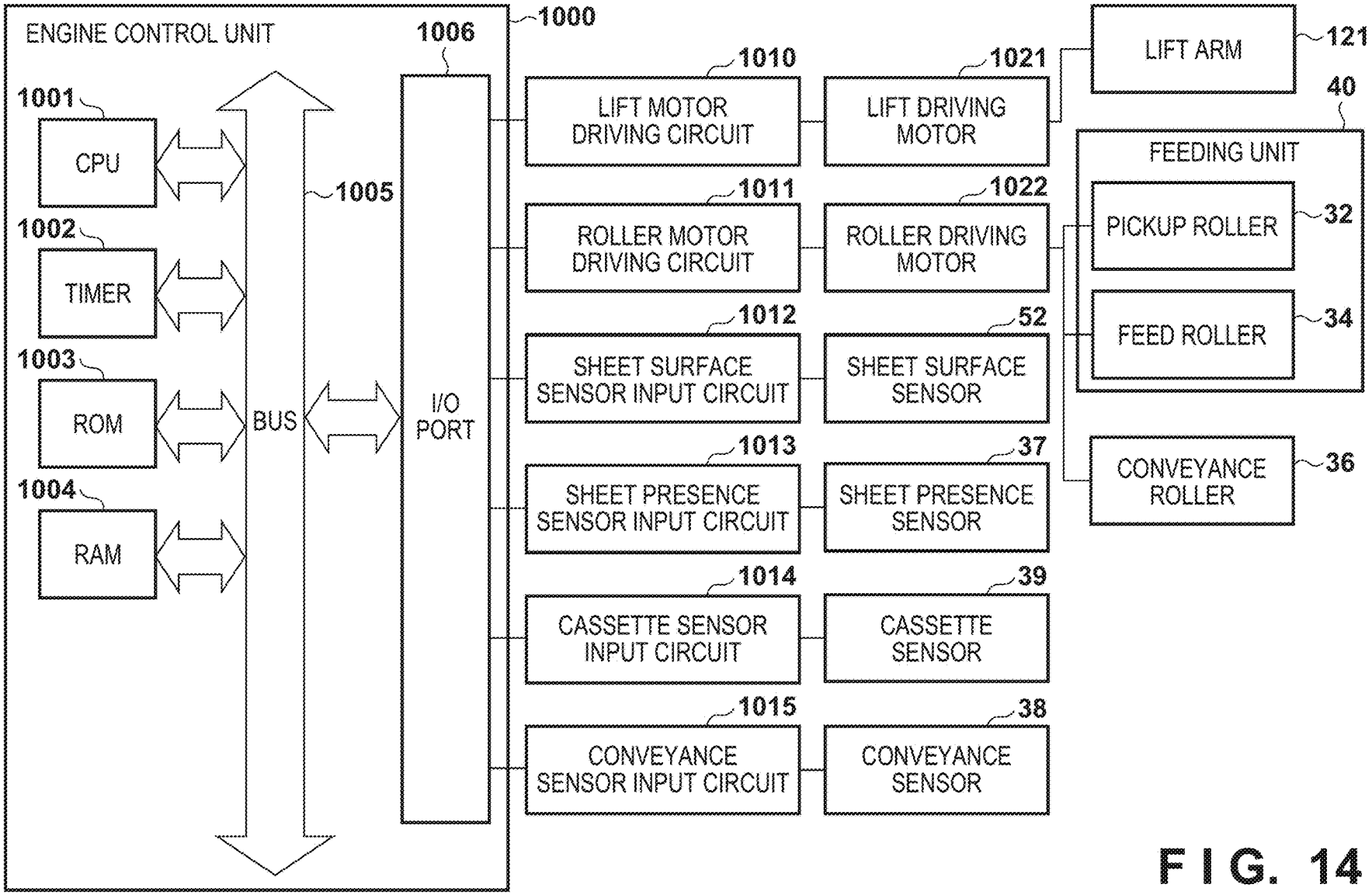
FIG. 14 is a hardware block diagram according to fourth to sixth embodiments of the present invention.

FIG. 14 is a hardware block diagram illustrating a control system in particular according to the present embodiment. A CPU 1001 that controls the image forming apparatus 1 as a whole, a timer 1002 the generates a control timing, a ROM 1003 that stores a control program, a RAM 1004 that stores data and the like, and an I/O port 1006 are connected over a bus 1005. The I/O port 1006 connects a lift motor driving circuit 1010, a roller motor driving circuit 1011, a sheet surface sensor input circuit 1012, a sheet presence sensor input circuit 1013, and a cassette sensor input circuit 1014. The lift motor driving circuit 1010 drives a lift driving motor 1021 that operates in tandem with the lift arm 121. The roller motor driving circuit 1011 drives a roller driving motor 1022 that operates in tandem with the pickup roller 32 and the feed roller 34. The sheet surface sensor input circuit 1012 inputs a digitalized output value from the sheet surface sensor 52 to the I/O port 1006. The sheet presence sensor input circuit 1013 inputs a digitalized output value from the sheet presence sensor 37 to the I/O port 1006. The cassette sensor input circuit 1014 inputs a digitalized output value from the cassette sensor 39 to the I/O port 1006. The sheet presence sensor 37 performs recording material detection, which detects a sheet bundle stacked in the sheet feed cassette 11. The cassette sensor 39 performs sheet feeding part detection, which detects when the sheet feed cassette 11, which is mountable and removable, has been mounted or removed. The sheet surface sensor 52 detects whether the top surface of the sheet bundle is at a height at which sheets can be conveyed.

The CPU 1001 drives the pickup roller 32 and the feed roller 34 by operating the I/O port 1006 over the bus 1005. Additionally, by accessing the output values from the sensors at the I/O port 1006 over the bus 1005, the CPU 1001 confirms the states of the detected items indicated by the sheet surface sensor 52, the sheet presence sensor 37, and the cassette sensor 39.

Figure 15:
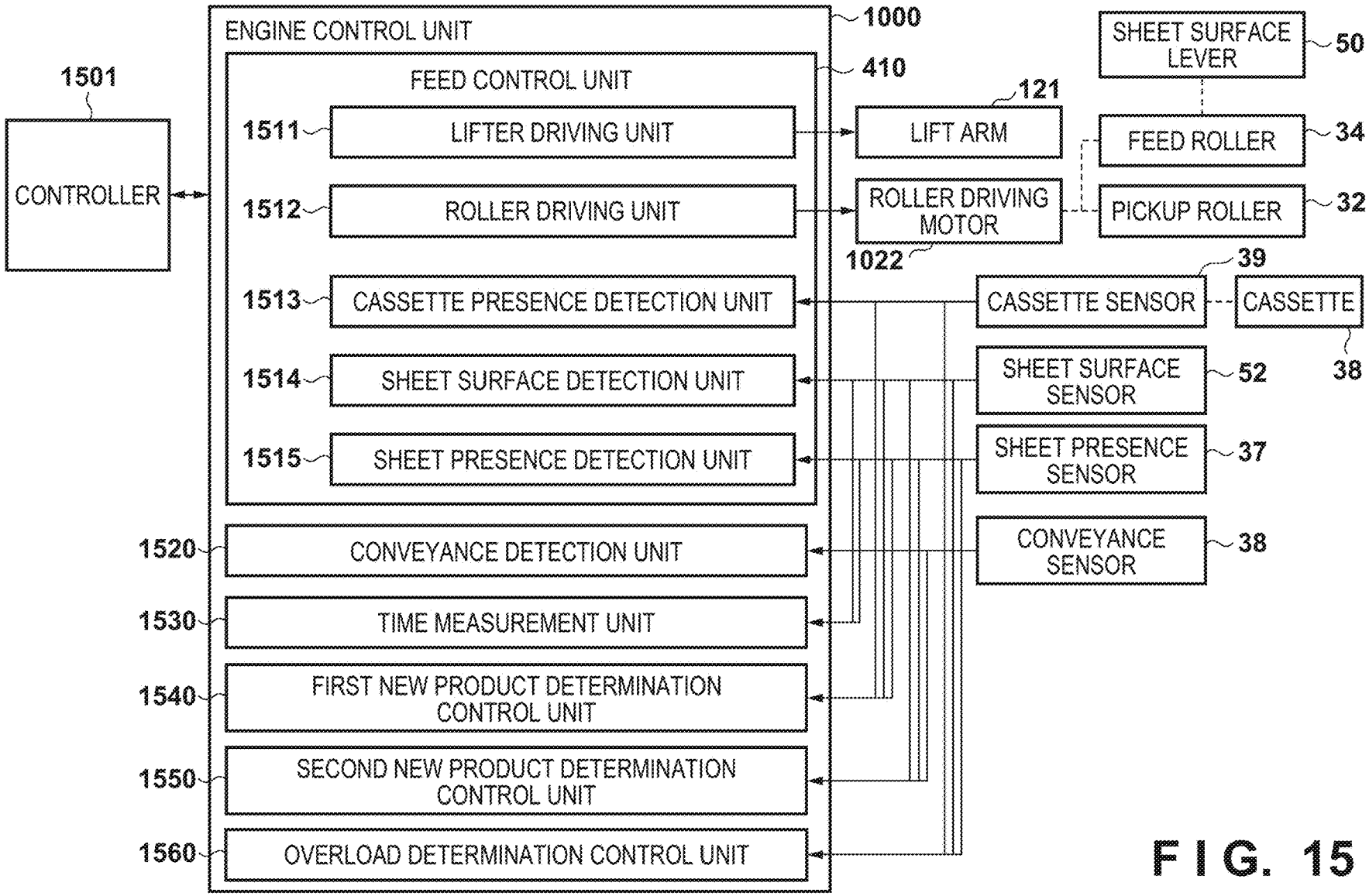
FIG. 15 is a control block diagram according to the fourth to sixth embodiments of the present invention.

Note the FIGS. 14 and 15 are drawings which are also used in the fifth and sixth embodiments (described later), and constituent elements used only in the fifth or sixth embodiments will not be described here.

Function Block Diagram

FIG. 15 is a block diagram illustrating a functional configuration according to the present invention. This block diagram illustrates function blocks implemented by the hardware configuration illustrated in FIG. 14.

A sheet feed control unit 1510 performs lift-up control when a cassette presence detection unit 1513 detects that the cassette 11 is present using the cassette sensor 39. A lifter driving unit 1511 instructs the lift driving motor 1021 to drive, which raises and lowers the lift arm 121. A roller driving unit 1512 instructs the roller driving motor 1022 to drive, which causes the feed roller 34 and the pickup roller 32 attached to the feed shaft 332 to rotate. Furthermore, the rotation of the feed roller 34 and the idler gear 302 causes the state of the sheet surface lever 50 to switch. A sheet surface detection unit 1514 detects whether the sheet is at a height at which the sheet can be fed, according to the light-blocking state or the light-transmissive state detected by the sheet surface sensor 52. In this example, if the state is the light-blocking state, the sheet is determined to be at a height at which the sheet can be fed.

A sheet presence detection unit 1515 uses the sheet presence sensor 37 to detect whether the sheet bundle Sa is present. A first new product determination control unit 1540 determines whether the feeding unit 40 is new based on detection results from the cassette sensor 39, the sheet surface sensor 52, and the sheet presence sensor 37. The first new product determination control unit 1540 also determines whether the feeding unit 40 is new based on a detection result from the sheet surface sensor 52 after a lifter part 13 has been lowered (lifted down) by the lifter driving unit 1511. The first new product determination control unit 1540 also detects and makes a notification that the sheet bundle Sa is not present, and detects and makes a notification that the feeding unit 40 has malfunctioned, based on the detection results from the cassette sensor 39, the sheet surface sensor 52, and the sheet presence sensor 37.

First New Product Determination Control Unit

Figure 16A:
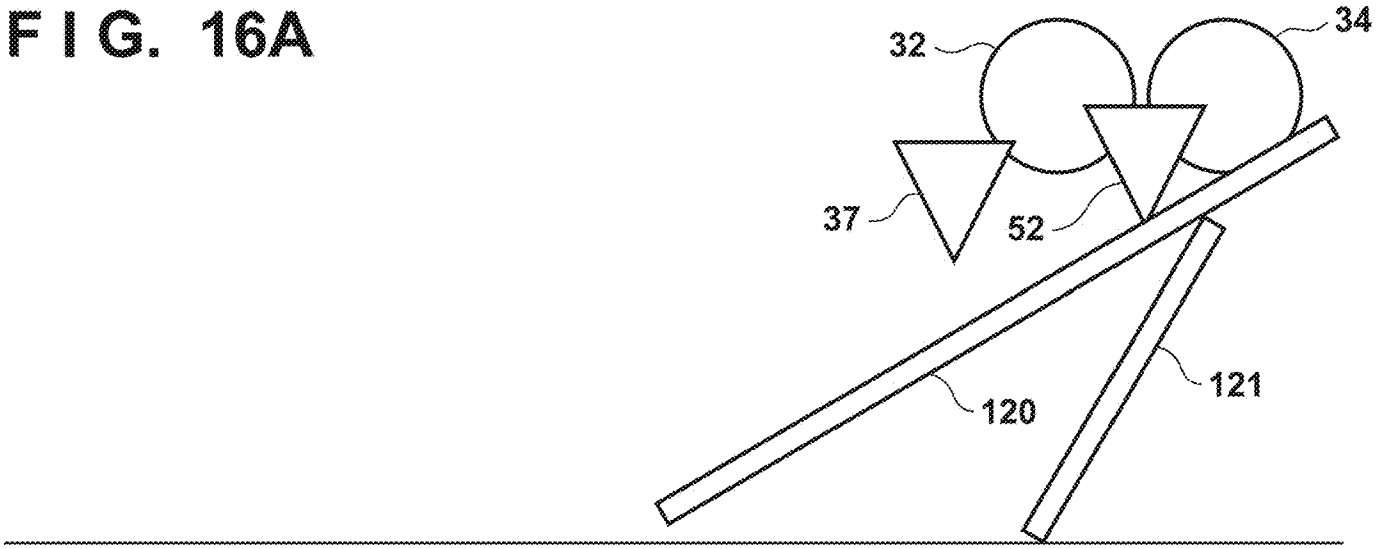
FIGS. 16A and 16B are diagrams illustrating states determined in first new product determination control according to the fourth embodiment of the present invention.

A method by which the first new product determination control unit 1540 determines whether the feeding unit 40 is new will be described next with reference to FIGS. 16A and 16B. FIG. 16A is a cross-sectional view illustrating a state in which no sheet bundle Sa is present within the sheet feed cassette 11, and the middle plate 120 has been lifted up by the lift arm 121. On the other hand, FIG. 16B is a cross-sectional view illustrating a state after the feeding unit 40 has been replaced with a new unit, where the sheet bundle Sa contains an amount which cannot be detected by the sheet presence sensor 37.

In the state illustrated in FIG. 16A, the middle plate 120 is raised and makes contact with the sheet surface detection plate 306, and the sheet surface sensor 52 is in the light-blocking state due to the sheet surface lever 50. Because there is no sheet bundle Sa, the sheet presence sensor 37 detects that there is no sheet. The sheet surface sensor 52 illustrated in FIG. 16B is in the light-blocking state because the holding member 307 is lifting up a lifting surface 50*c* of the sheet surface lever 50. Additionally, the middle plate 120 descends in response to the sheet feed cassette 11 being opened when replacing the feeding unit 40, and the sheet presence sensor 37 therefore cannot detect the sheet bundle Sa. The detection results from the sensors 37 and 52 illustrated in FIGS. 16A and 16B are therefore the same, and need to be distinguished.

Figure 16B:
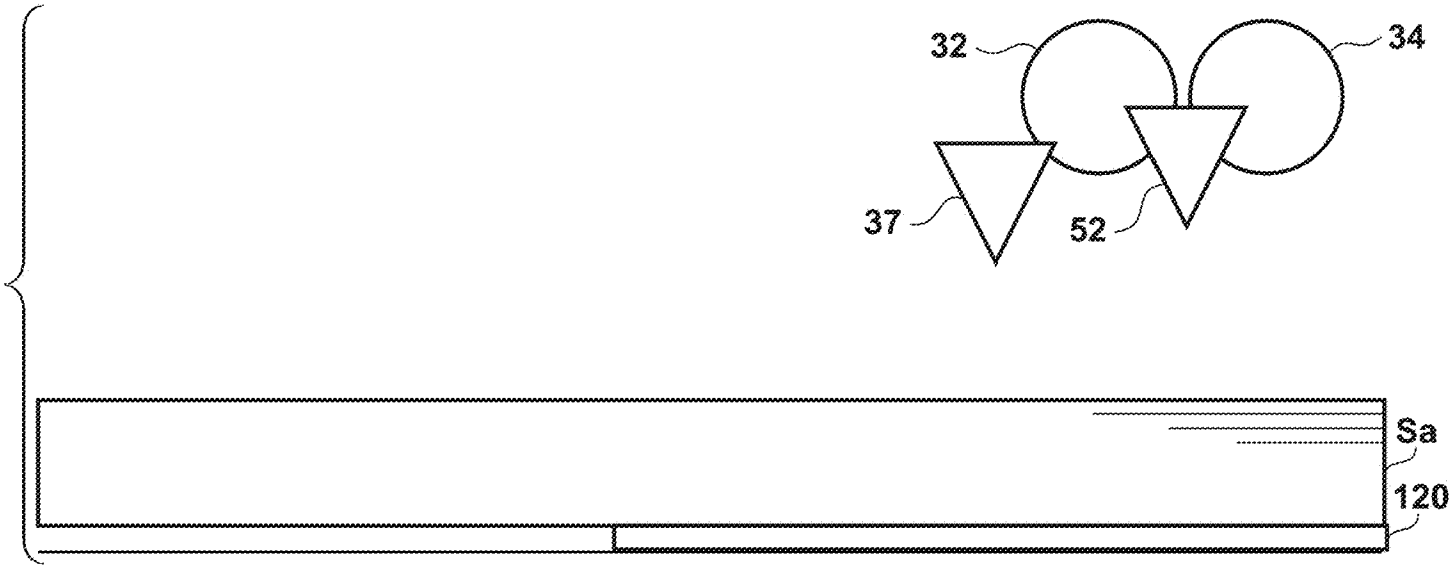

Assuming the state illustrated in FIG. 16B, if the pickup roller 32 has been driven to detect a new feeding unit 40, the feeding unit 40 can be determined to be a new unit when the detection result from the sheet surface sensor 52 has changed from the light-blocking state to the light-transmissive state. However, in the case illustrated in FIG. 16A, the pickup roller 32 and the middle plate 120 rub together, which wears down the pickup roller 32. Accordingly, the unit being new (FIG. 16B) and the unit not being new (FIG. 16A) are distinguished based on an opening/closing history of the sheet feed cassette 11. The opening/closing history of the sheet feed cassette 11 is stored in the RAM 1004 when the cassette sensor 39 detects that the sheet feed cassette 11 has been opened.

It is sufficient to store the detection states of the cassette sensor 39, which indicate that the sheet feed cassette 11 was opened immediately before checking the sheet surface sensor 52 and the sheet presence sensor 37, as the opening/closing history.

Immediately after the sheet feed cassette 11 has been opened or closed, the sheet surface sensor 52 in FIG. 16A is in the light-transmissive state due to the middle plate 120 having descended. However, the sheet surface sensor 52 in FIG. 16B remains in the light-blocking state due to the holding member 307, even if the middle plate 120 has descended. The sheet surface sensor 52 entering the light-blocking state even after the cassette sensor 39 has detected opening or closing occurs only when the feeding unit 40 is new, which makes it possible to distinguish between when the unit is new or not new.

However, if the feeding unit 40 is replaced with a new unit and the sheet feed cassette 11 is opened and closed while the power is off, the CPU 1001 cannot store an indication that the sheet feed cassette 11 has been opened and closed in the RAM 1004. Accordingly, in the sequence described above, whether the state is that illustrated in FIG. 16A or that illustrated in FIG. 16B cannot be determined even by referring to the opening/closing history of the sheet feed cassette. The user is therefore prompted to open and close the sheet feed cassette 11 via controller 1501. The timing thereof may be immediately after the power is turned on, for example. In the present embodiment, the sheet feed cassette 11 can be prompted to be opened and closed by notifying the user that there is no sheet bundle Sa immediately after the power has been turned on. The sheet feed cassette 11 is opened and closed as a result, and the middle plate 120 descends. If the middle plate 120 descends in the state illustrated in FIG. 16A, the sheet surface sensor 52 enters the non-light-blocking state. On the other hand, if the feeding unit 40 is new, the sheet surface sensor 52 is in the light-blocking state even if the middle plate 120 has descended (FIG. 16B). This makes it possible to distinguish whether the unit is new.

When the feeding unit 40 is determined to be new, a switching operation for disengaging the support part 307*f* of the holding member 307 from the lifting surface 50*c* of the sheet surface lever is performed by rotating the pickup roller 32. The sheet surface sensor 52 continuing to detect the light-blocking state despite the switching operation having been performed indicates that the feeding unit 40 is not connected correctly, and a malfunction is determined to have occurred. In such a case, a notification is made via the controller 1501.

In the case of mechanism in which the lift arm 121 can descend, the unit may be determined to be new when a lift-down instruction is made and the sheet surface sensor 52 switches from the light-blocking state to the light-transmissive state.

Flow of First New Product Determination Control

Figure 17:
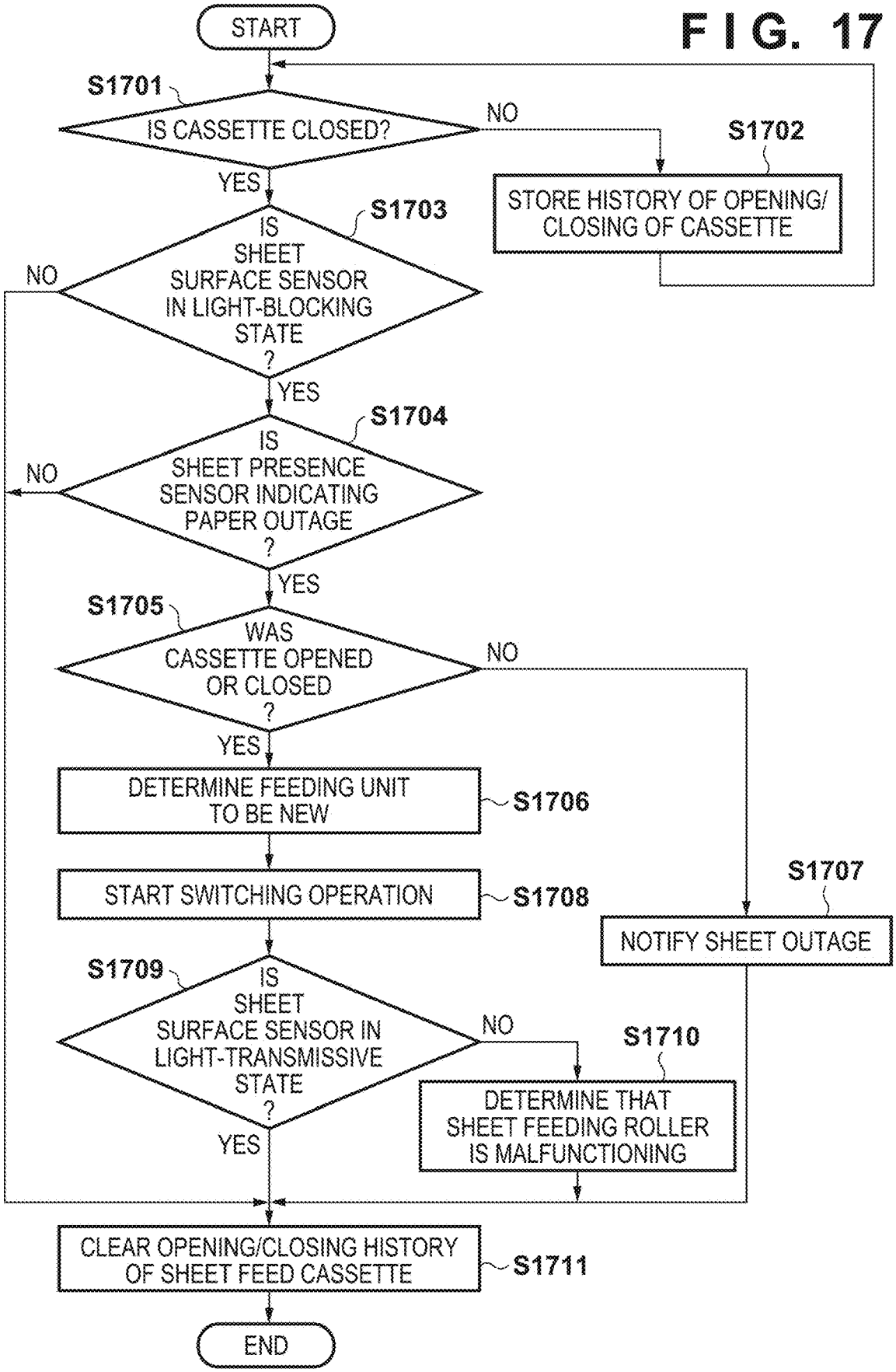
FIG. 17 is a flowchart illustrating the first new product determination control according to the fourth embodiment of the present invention.

FIG. 17 is a flowchart related to the first new product determination control unit 1540. This processing is executed by the CPU 1001 of an engine control unit 1000. This processing may be executed, for example, when the sheet feed cassette is detected to be open immediately after the power is turned on, and may be executed in parallel with other processing for controlling the image forming apparatus. Note that the processing illustrated in FIG. 17 may be started from step S1701 after a message prompting the sheet feed cassette 11 to be opened and closed, as described above, is output after the power is turned on, and the sheet feed cassette is confirmed to have been opened.

The cassette presence detection unit 1513 detects whether the cassette 11 is closed (step S1701). If the cassette 11 is open, history information indicating that there is opening/closing history of the cassette 11 is stored in an opening/closing storage part of the RAM 1004 (step S1702). If the cassette sensor 39 detects that the cassette 11 has been closed, it is determined whether the sheet surface sensor 52 is in the light-blocking state (step S1703). If the sheet surface sensor 52 is determined to be in the light-blocking state, it is determined whether the sheet presence sensor 37 detects that no sheet bundle Sa is stacked (step S1704). If it is determined that the sheet presence sensor 37 detects that no sheet bundle Sa is stacked, the history information of the sheet feed cassette stored in step S1702 is accessed to obtain the opening/closing history (step S1705).

If it is determined in step S1705 that the sheet feed cassette being opened is stored in the opening/closing history, the feeding unit 40 is determined to be new (step S1706). In step S1706, a counter for estimating the replacement timing of the feeding unit 40 is reset to 0, for example. This counter is incremented by 1 each time a sheet is fed, for example, and when a predetermined value is reached, a message indicating that it is time for the feeding unit 40 to be replaced is output to the user. Furthermore, when the feeding unit 40 is determined to be new, the switching operation for disengaging the support part 307*f* of the holding member 307 from the lifting surface 50*c* of the sheet surface lever is performed by driving the pickup roller 32 (step S1708).

After performing the switching operation in step S1708, whether the sheet surface sensor 52 is in the light-transmissive state (the non-light-blocking state) is detected (step S1709). If the sheet surface sensor 52 is in the light-blocking state in step S1709, the feeding unit 40 is determined to have malfunctioned (step S1710). In step S1710, for example, the state of the image forming apparatus is shifted from a printing standby state to an error state, where printing is not possible until the malfunction is rectified, and a message is output to the user. The opening/closing storage part is then reset or cleared (step S1711). The initial value may be any value as long as the value does not indicate that the sheet feed cassette 11 is open. Step S1706 may be performed after the sheet surface sensor 52 is detected to be in the light-transmissive state in step S1710.

If the sheet surface sensor 52 is in the light-transmissive state in step S1709, the opening/closing storage part is reset (step S1711). The processing performed by the first new product determination control unit 1540 ends thereafter. When the sheet surface sensor 52 is in the light-blocking state in step S1703 and when the sheet presence sensor 37 detects that the sheet bundle Sa is present in step S1704, the opening/closing storage part is reset (step S1711) and the processing by the first new product determination control unit 1540 ends.

If the sheet feed cassette being opened is not stored in the opening/closing history in step S1705, the user is notified via the controller 1501 that there is no sheet bundle Sa, or the user is prompted to refill the sheets (step S1707). The opening/closing storage part is then reset (step S1711).

As described above, according to the present embodiment, sheet feeding operations are not performed when the feed roller is replaced with a new unit and the sheet cannot be detected by the sheet presence sensor in the cassette. Determining that the feeding unit is new based on the opening/closing history of the cassette without performing sheet feeding operations makes it possible to prevent the feed roller from being worn down.

Fifth Embodiment

A fifth embodiment of the present invention will be described next. The present embodiment will describe control for determining that the feeding unit is new when the sheet surface sensor 52 is in the light-blocking state and the sheet presence sensor 37 detects a sheet in the cassette, without feeding sheets unnecessarily. Note that parts that are the same as in the first embodiment will not be described here.

Hardware Block Diagram

A hardware block diagram according to the present embodiment will be described first with reference to FIG. 14. Parts that are the same as in the first embodiment will not be described here. The I/O port 1006 is connected to the roller motor driving circuit 1011 and a conveyance sensor input circuit 1015. The roller motor driving circuit 1011 drives the roller driving motor 1022, which operates in tandem with the conveyance roller 36. The conveyance sensor input circuit 1015 digitizes a detection signal from the conveyance sensor 38, which detects a sheet being conveyed, and inputs the signal to the I/O port 1006.

The CPU 1001 drives the conveyance roller 36 by operating the I/O port 1006 over the bus 1005. Additionally, by accessing the I/O port 1006 over the bus 1005, the CPU 1001 confirms the value of the signal output from the conveyance sensor 38.

Function Block Diagram

The functional configuration of the present fifth embodiment will be described next with reference to FIG. 15. Parts that are the same as in the first to fourth embodiments will not be described here.

A conveyance detection unit 1520 detects that a sheet is being conveyed, using the conveyance sensor 38. A second new product determination control unit 1550 determines whether the feeding unit 40 is new based on detection results from the conveyance sensor 38, the sheet surface sensor 52, and the sheet presence sensor 37. Additionally, after rotating the feed roller 34 using the roller driving unit 1512, the second new product determination control unit 1550 detects and makes a notification as to whether there is a paper jam, based on the detection result from the conveyance sensor 38.

Second New Product Determination Control Unit

Figure 18A:
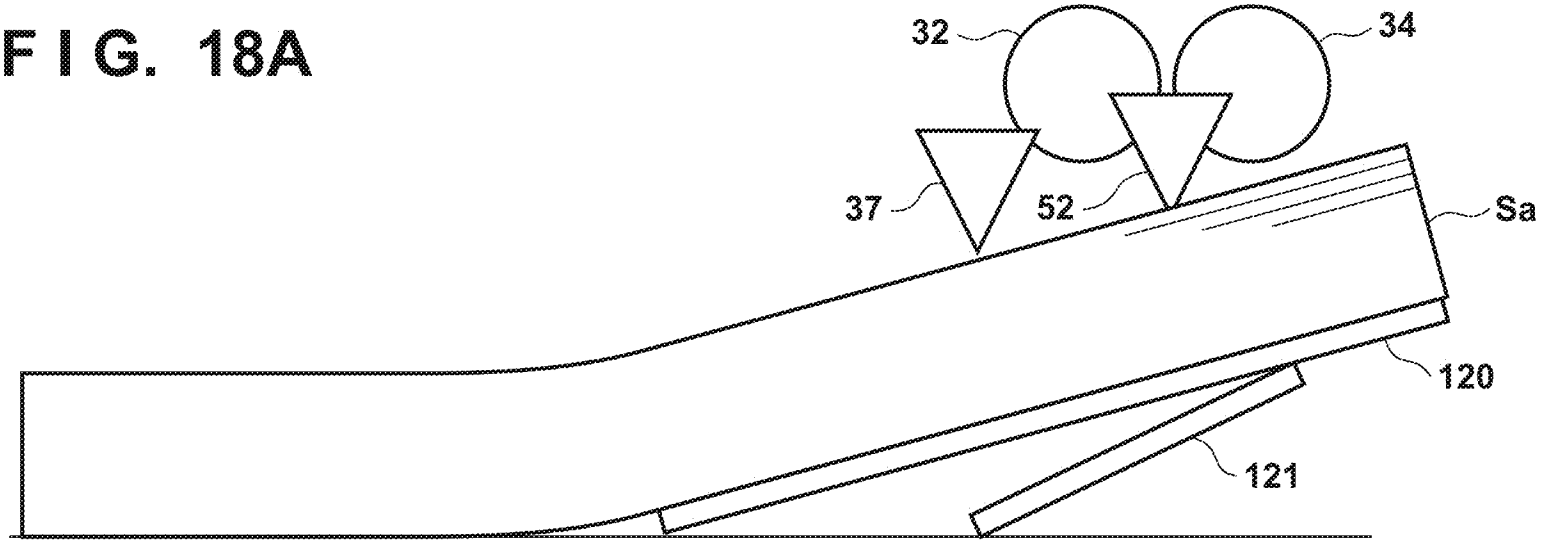
FIGS. 18A and 18B are diagrams illustrating states determined in second new product determination control according to the fifth embodiment of the present invention.
Figure 18B:
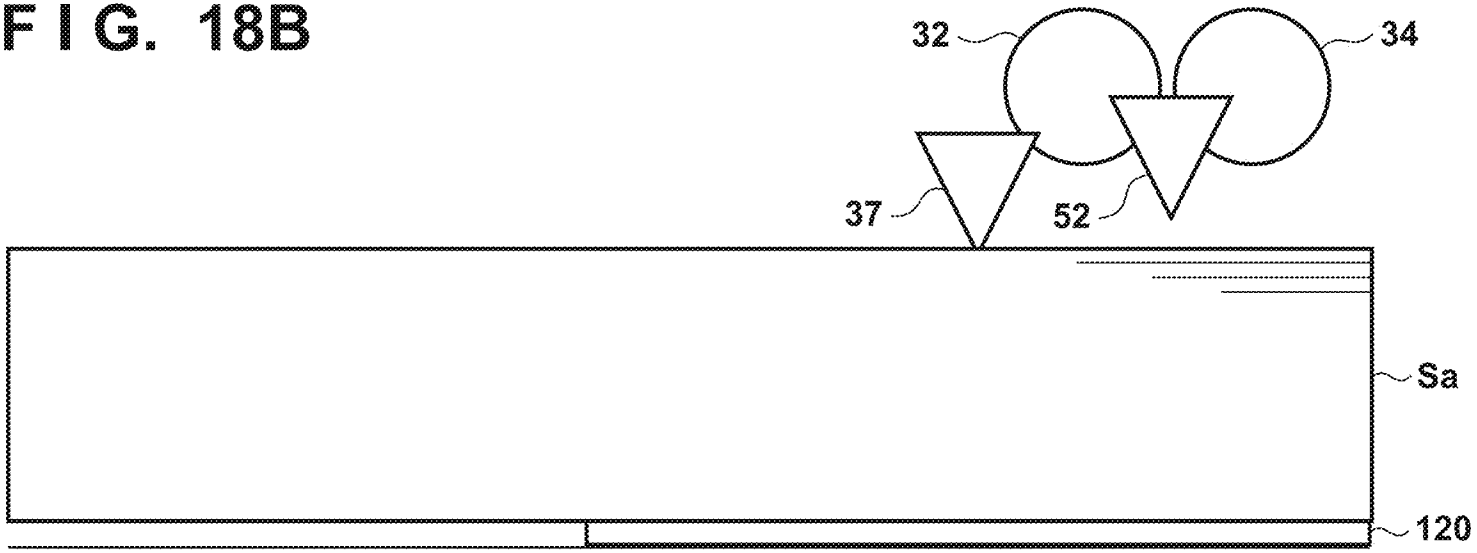

A method by which the second new product determination control unit 1550 determines whether the feeding unit 40 is new will be described next with reference to FIGS. 18A and 18B. FIG. 18A is a cross-sectional view illustrating a state in which a sheet bundle Sa is present within the cassette 11, and the middle plate 120 has been lifted up by the lift arm 121. On the other hand, FIG. 18B is a cross-sectional view illustrating a state after the feeding unit 40 has been replaced with a new unit, where the sheet bundle Sa contains an amount which can be detected by the sheet presence sensor 37 even if the lifting up has not been performed.

In FIG. 18A, a detection plate 306 is pushed up by the lifted sheet bundle Sa, and the sheet surface sensor 52 is in the light-blocking state due to the flag part 50*b* which has descended as a result. Light is blocked for the sheet presence sensor 37 by a sheet presence flag (not shown), which is pushed up by the sheet bundle Sa, and thus a sheet is detected as being present. The sheet surface sensor 52 illustrated in FIG. 18B is in the light-blocking state because the feeding unit 40 has been replaced with a new unit and the holding member 307 is lifting up the lifting surface 50*c* of the sheet surface lever 50. Because the sheet bundle Sa contains an amount that can be detected even if the lifting up has not been performed, the sheet presence sensor 37 detects that a sheet is present. The detection results from the sensors 37 and 52 illustrated in FIGS. 18A and 18B are therefore the same, and need to be distinguished. The feeding unit 40 can be determined to be new if the detection result from the sheet surface sensor 52 has changed from the light-blocking state to the light-transmissive state after the pickup roller 32 has been driven in the state illustrated in FIG. 18A or FIG. 18B.

However, in the state illustrated in FIG. 18A, the rotating pickup roller 32 feeds the uppermost sheet S1 in the sheet bundle, and the sheet is conveyed unnecessarily.

Accordingly, whether the feeding unit 40 is new is determined by using the driving of the pickup roller 32 for detecting the new feeding unit 40, which is performed through the sheet feeding operations during printing. Assume that the sheet feeding operations are performed when printing is started, and the pickup roller 32 attempts to feed a sheet. In the case illustrated in FIG. 18A, the uppermost sheet S1 of the sheet bundle is fed, and the sheet is detected by the conveyance sensor 38. On the other hand, in the case illustrated in FIG. 18B, the pickup roller 32 and the sheet S1 are not in contact, and the sheet is therefore not fed. Therefore, no sheet is detected by the conveyance sensor 38. Additionally, the holding member 307 is separated due to the sheet feeding operations, and the sheet surface sensor 52 is therefore in the light-transmissive state. Whether the feeding unit 40 is new can therefore be distinguished according to whether a sheet is detected by the conveyance sensor 38 during printing.

Flow of Second New Product Determination Control

Figure 19:
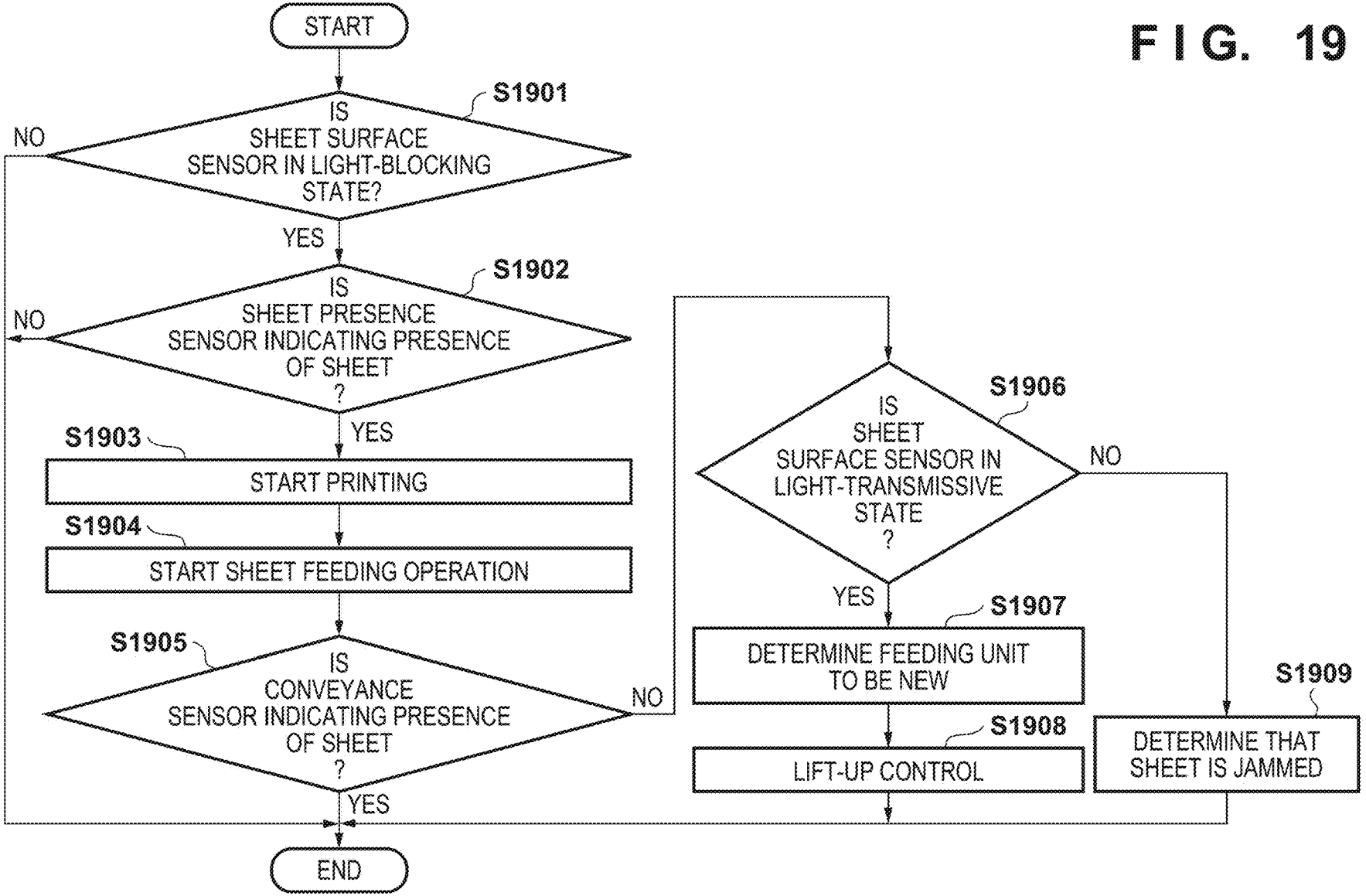
FIG. 19 is a flowchart illustrating the second new product determination control according to the fifth embodiment of the present invention.

FIG. 19 is a flowchart related to the second new product determination control unit 1550. This flow may be executed by the CPU 1001 when printing.

The engine control unit 1000 determines whether the sheet surface sensor 52 is in the light-blocking state (step S1901). If the sheet surface sensor 52 is detected as being in the light-blocking state, whether the sheet bundle Sa is present, detected by the sheet presence sensor 37, is determined (step S1902). If the sheet presence sensor 37 determines that the sheet bundle Sa is detected, printing is started in response to a print instruction made by the controller 1501 (step S1903). Here, the print instruction is a conveyance instruction. The pickup roller 32 is driven to feed the uppermost sheet S1 of the sheet bundle (step S1904).

After step S1904, whether a sheet is present in the conveyance path is determined by the conveyance sensor 38 (step S1905).

If the sheet is not detected within a predetermined length of time in step S1905, it is determined whether the sheet surface sensor 52 is in the light-transmissive state (step S1906). If the sheet surface sensor 52 is determined to be in the light-transmissive state, the feeding unit 40 is determined to be new (step S1907). In step S1907, a counter for estimating the replacement timing of the feeding unit 40 is reset to 0, for example. This is the same as in the first embodiment. Furthermore, lift-up control is performed until the sheet surface sensor 52 changes to the light-blocking state (step S1908). Once the lift-up ends, the printing started in step S1903 is continued. If the sheet surface sensor 52 is in the light-blocking state before the lift-up control is performed in step S1907, the sheet surface detection plate 306 is determined to be pushed up due to a paper jam near the feeding unit 40, and a notification indicating the jam is made (step S1909).

When a sheet is detected is step S1905, the processing of FIG. 17, performed by the second new product determination control unit 1550, ends. When the sheet surface sensor 52 is in the light-blocking state in step S1901 and when the sheet presence sensor 37 detects that the sheet bundle Sa is not present in step S1902, the processing by the second new product determination control unit 1550 ends.

As described above, according to the present embodiment, when the feed roller is replaced with a new unit and a sheet in the cassette is detected by the sheet presence sensor, the feeding unit can be determined to be new based on the result of the conveyance sensor detecting a sheet. This makes it possible to detect a new unit utilizing operations that drive the pickup roller when feeding sheets during normal printing operations, which in turn makes it possible to prevent sheets from being fed unnecessarily due to new sheets being detected outside the printing operations.

Sixth Embodiment

A sixth embodiment of the present invention will be described next. The present embodiment will describe control for detecting whether the cassette is in the overloaded state, even in a configuration where the sheet surface sensor is put into the light-blocking state when the feeding unit is new. Here, the "overloaded state" is a state where the loading height of the sheet bundle in the cassette exceeds the permissible height for the cassette. Note that parts that are the same as in the first embodiment will not be described here.

Hardware Block Diagram

The hardware configuration according to the present embodiment is the same as in the fourth and fifth embodiments and will therefore not be described.

Function Block Diagram

The functional configuration of the present embodiment will be described next with reference to FIG. 15. Parts that are the same as in the first to fifth embodiments will not be described here. A time measurement unit 1530 measures the time at which the detection results of the sheet surface sensor 52 and the sheet presence sensor 37 change. An overload determination control unit 1560 determines whether the sheet bundle Sa in the sheet feed cassette 11 is in the overloaded state based on detection results from the cassette sensor 39, the sheet surface sensor 52, and the sheet presence sensor 37.

Overload Determination Control

Figure 20A:
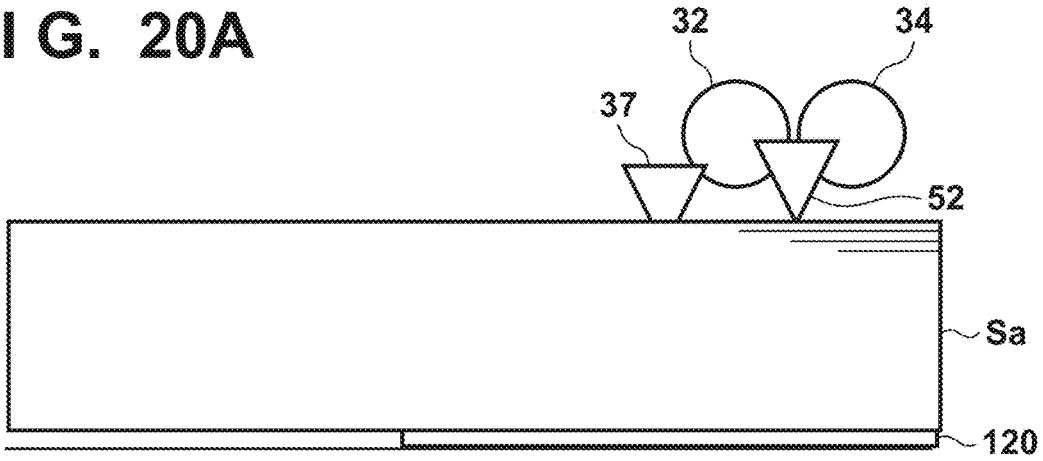
FIGS. 20A to 20D are diagrams illustrating states determined in overload determination control according to the sixth embodiment of the present invention.
Figure 20B:
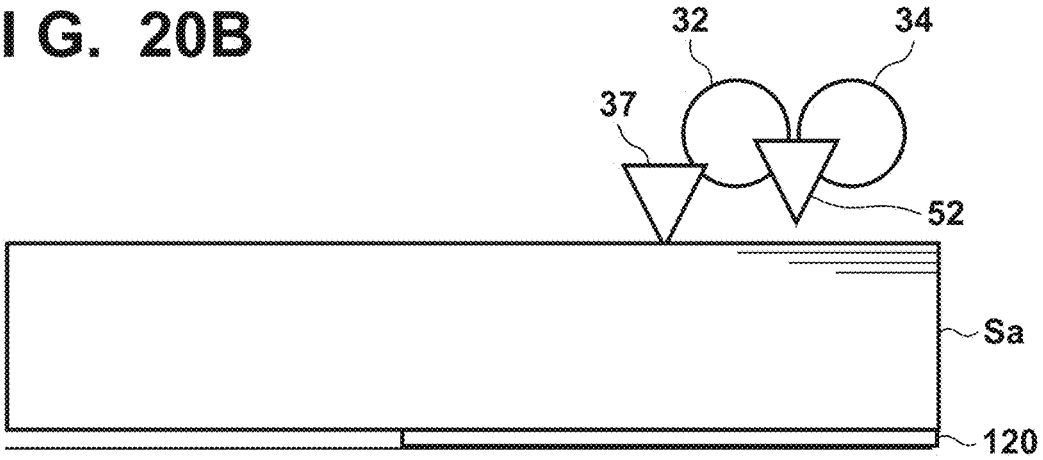

A method for distinguishing whether the sheet feed cassette 11 is in the overloaded state through overload determination control will be described next with reference to FIGS. 20A to 20C. FIG. 20A is a cross-sectional view of the cassette 11 in the overloaded state, and FIG. 20B is a cross-sectional view illustrating a state after the feeding unit 40 has been replaced with a new unit, where the sheet bundle Sa contains an amount which can be detected by the sheet presence sensor 37 even if the lifting up has not been performed. In FIG. 20A, the sheet surface detection plate 306 is pushed up by the sheet bundle Sa stacked to the overloaded state, and the light-blocking state is detected by the sheet surface sensor 52. Light is blocked for the sheet presence sensor 37 by a sheet presence flag (not shown), which is pushed up by the sheet bundle Sa, and thus a sheet is detected as being present. In FIG. 20*b*, the state detected by the sheet surface sensor 52 switches from the light-transmissive state to the light-blocking state when the new feeding unit 40 is mounted, and when the sheet feed cassette 11 is closed, the detection state of the sheet presence sensor 37 transitions from a sheet not being present to a sheet being present. The logical state of the sensors illustrated in FIGS. 20A and 20B is therefore the same after the sheet feed cassette 11 is closed, and the states therefore need to be distinguished.

Accordingly, the overloaded state is determined based on a change in the detection result from the sheet surface sensor 52 and the detection result from the sheet presence sensor 37 up until the cassette 11 is closed.

Figure 20C:
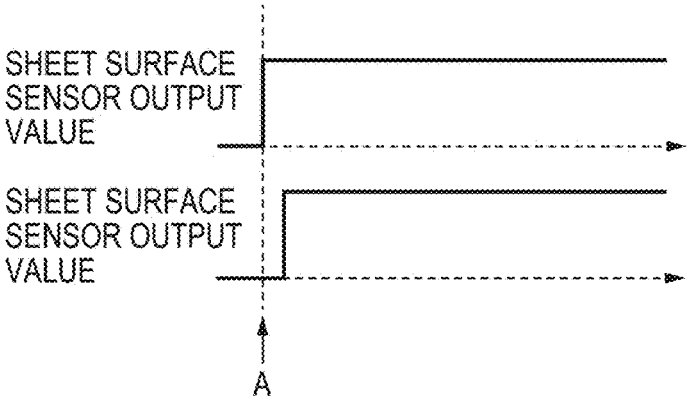
Figure 20D:
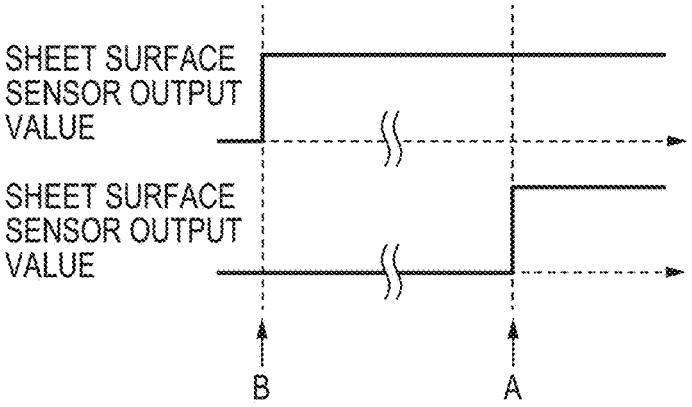

FIG. 20C is a graph illustrating a detection result (a main power signal value) when the cassette 11 in the overloaded state is closed, and FIG. 20D is a graph illustrating a detection result when the feeding unit 40 is replaced with a new unit. The horizontal axis represents time, and the vertical axis represents the value of the signal output by the sensor. Timing A is the timing at which the cassette 11 begins to close, and timing B is the timing at which the feeding unit 40 is replaced with a new unit. The sheet feed cassette 11 is configured, for example, to be inserted into the main body of the image forming apparatus 1 in the form of a drawer. Attaching the sheet feed cassette 11 from a state in which the sheet feed cassette 11 is removed will be called "closing" the cassette, and the reverse will be called "opening" the cassette. When the sheet feed cassette 11 is inserted into the main body of the image forming apparatus, the sheet surface is first detected by the sheet surface sensor 52, and the sheet presence sensor 37 then detects the sheet bundle Sa.

In FIG. 20C, the detection of the light-blocking state by the sheet surface sensor 52 and the detection of the sheet by the sheet presence sensor 37 occur consecutively in response to the sheet bundle Sa being stacked to the overloaded state when the cassette 11 is closed. In other words, the time difference from when the sheet surface sensor 52 detects the sheet surface to when the detection result from the sheet presence sensor 37 changes is shorter than the time difference when the feeding unit 40 is replaced with a new unit. On the other hand, in FIG. 20D, when the feeding unit 40 is replaced, the sheet surface sensor 52 is in the light-blocking state even if the sheet feed cassette 11 is not inserted. To replace the feeding unit 40, it is necessary to secure space near the feeding unit 40. It is also necessary to remove the sheet feed cassette 11 set in the LBP main body 1, or to remove the stacked sheet bundle Sa once. Accordingly, it takes a certain amount of time from the timing B, at which the feeding unit 40 is replaced with a new unit and the sheet surface sensor 52 detects the light-blocking state, to the timing A, at which the cassette 11 in which the sheet bundle Sa is stacked is closed.

Accordingly, the time from when the sheet surface sensor 52 switches from the light-transmissive state to the light-blocking state to when the sheet presence sensor 37 detects that there is no sheet is compared to the time when the sheet presence sensor 37 detects that there is a sheet. The measurement of this time starts when the sheet surface sensor 52 switching from the light-transmissive state to the light-blocking state is detected, and the time until the sheet presence sensor 37 switches from not detecting a sheet to detecting a sheet is measured. Note that the conditions for starting and ending the measurement may be reversed in accordance with the positional relationship between the sheet surface sensor 52 and the sheet presence sensor 37. In other words, if the sheet bundle Sa is first detected by the sheet presence sensor 37 when the sheet feed cassette 11 is inserted, the conditions for starting and ending the measurement may be reversed from the order described above. When the cassette sensor 39 detects that the cassette 11 has been closed, the overloaded state is distinguished out by comparing the measured time with a threshold time used for the overload determination. Assuming the distance from the position of the sheet surface sensor 52 to the position of the sheet presence sensor 37 is 50 mm and the speed at which the user closes the cassette 11 is 100 mm/sec, the threshold time is set to 500 msec. Although the threshold time is set as described above in the present embodiment, the configuration and the speed at which the user closes the cassette 11 may be changed, or a setting time may be defined by adding a margin for determining whether the cassette is overloaded.

Flow of Overload Determination Control

Figure 21:
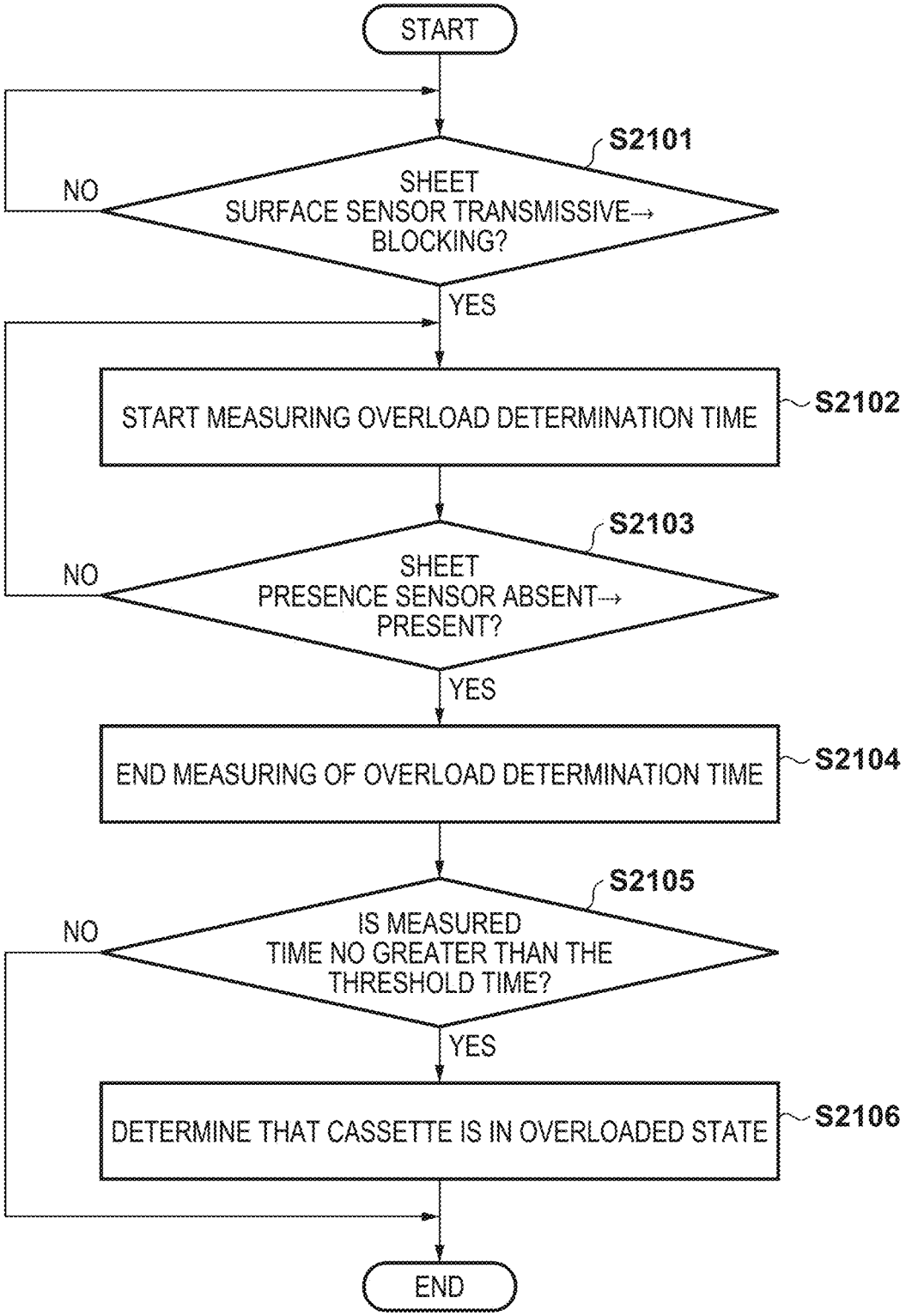
FIG. 21 is a flowchart illustrating the overload determination control according to the sixth embodiment of the present invention.

FIG. 21 is a flowchart pertaining to the overload determination control unit 1560 of the engine control unit 1000. The CPU 1001 is the main executing entity for the hardware. The overload determination control unit 1560 performs the processing in FIG. 21 when the cassette sensor 39 detects that the cassette 11 is open.

The engine control unit 1000 determines that the sheet surface sensor 52 switches from the light-transmissive state to the light-blocking state (step S2101). When the change in the state of the sheet surface sensor 52 is detected in step S2101, the timer 1002 begins measuring the time (step S2102). In step S2101, the state of the sheet surface sensor 52 is monitored at regular intervals, e.g., until the state of the sheet surface sensor 52 changes from the light-transmissive state to the light-blocking state.

Whether the sheet has been detected by the sheet presence sensor 37 while the time is being measured is determined (step S2103). The time measurement ends when the sheet presence sensor 37 detects the sheet in step S2103 (step S2104). In step S2103, the state of the sheet presence sensor 37 is monitored at regular intervals, e.g., until the sheet presence sensor 37 detects the sheet. After the time measurement ends, the measured time is compared with the predetermined threshold time mentioned above (step S2105).

If the measured time is no greater than the threshold time, the sheet bundle Sa is determined to be in the overloaded state (step S2106). When the sheet bundle is determined to be overloaded, the user may be notified of the overloaded state via the controller 1501. If the measured time exceeds the threshold time, the feeding unit 40 is determined to be new, and the control ends. In this case, a counter value for estimating the replacement timing of the feeding unit 40 may be reset to 0.

As described above, according to the present embodiment, even in a configuration where the sheet surface sensor is put into a light-blocking state when the feeding unit is new, the overloaded state can be determined from the detection results of the sheet surface sensor and the sheet presence sensor when the cassette is closed. This makes it possible to determine the overloaded state even when the sheet surface sensor is used to detect new units.

According to all the above-described embodiments, the feeding unit 40 being replaced can be determined automatically, and the user can be accurately notified of the timing for replacing the feeding unit 40.

Although the foregoing six embodiments have been described using a feeding unit of an LBP, the present invention is not limited thereto. The present invention can be similarly applied in an optional sheet conveyance apparatus or the like. Furthermore, the image forming apparatus is not limited to an electrophotographic apparatus, and the present invention can also be applied in an ink jet image forming apparatus and the like, for example.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)?), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-097910, filed Jun. 14, 2023, Japanese Patent Application No. 2023-103597, filed Jun. 23, 2023 which are hereby incorporated by reference herein in their entirety.

What is claimed is:

1. A sheet feeding apparatus comprising:

a stacking unit including a lifting member in which a sheet-shaped recording material is stacked;

a detected part configured to be movable between a first position and a second position;

a detector configured to output:

a first signal when the detected part is in the first position; and a second signal when the detected part is in the second position, wherein in a state where the recording material is stacked on the lifting member and the lifting member is lifted, the detected part is in a position where the detector outputs the first signal;

a feeding unit configured to be mountable to and removable from a main body of the sheet feeding apparatus, the feeding unit including:

a feed roller that conveys the recording material; and a holding member including a supporting part and configured to be movable between a holding position and a retracted position; and a controller configured to detect whether the feeding unit has been replaced based on a signal output from the detector, wherein when the feeding unit with the holding member in the holding position is mounted to the main body, the supporting part is in contact with the detected part so that the detected part is in the first position, and wherein when the feeding unit is mounted to the main body and the feed roller is driven, the holding member retracts from the holding position to the retracted position so that the supporting part separates from the detected part and the detected part retracts from the first position to the second position.

2. The sheet feeding apparatus according to claim 1, wherein:

the detected part includes a light-blocking part, and the detector includes a light detection sensor that detects a light-transmissive state and a light-blocking state when the light-blocking part moves due to the detected part moving.

3. The sheet feeding apparatus according to claim 2, wherein:

the light-blocking part includes at least one slit in a light-blocking surface, and the detector detects a state change between the light-transmissive state and the light-blocking state a plurality of times during movement in one direction of an operating range of the detected part.

4. The sheet feeding apparatus according to claim 3, wherein when the holding member operates, the controller is configured to determine that:

the feeding unit has been replaced when the state detected by the detector has changed three times, and the recording material is stacked beyond a height at which the recording material is feedable and is in an overloaded state when the state detected by the detector has changed twice.

5. The sheet feeding apparatus according to claim 4, wherein the controller is configured to determine that the feeding unit has been replaced when, due to the holding member operating, the state detected by the detector has changed from the light-blocking state to the light-transmissive state, from the light-transmissive state to the light-blocking state, and from the light-blocking state to the light-transmissive state.

6. The sheet feeding apparatus according to claim 2, wherein the controller is configured to determine that the feeding unit has been replaced when, due to the holding member operating, the state detected by the detector has changed from the light-blocking state to the light-transmissive state.

7. The sheet feeding apparatus according to claim 1, wherein the detected part is included in the main body of the sheet feeding apparatus.

8. The sheet feeding apparatus according to claim 1, wherein the detected part is included in the feeding unit.

9. An image forming apparatus comprising:

the sheet feeding apparatus according to claim 1; and an image forming unit that forms an image on the recording material fed by the sheet feeding apparatus.

10. The sheet feeding apparatus according to claim 1, wherein the feeding unit includes a urging member configured to urge the holding member.

11. A sheet feeding apparatus comprising:

a stacking unit including a lifting member in which a sheet-shaped recording material is stacked;

a detected part configured to be movable between a first position and a second position;

a detector configured to output:

a first signal when the detected part is in the first position; and a second signal when the detected part is in the second position;

wherein in a state where the recording material is stacked on the lifting member and the lifting member is lifted, the detected part is in a position where the detector outputs the first signal, a driving unit configured to be attachable to and drive a removable feeding unit, the removable feeding unit including:

a feed roller that conveys the recording material; and a holding member including a supporting part and configured to be movable between a holding position and a retracted position; and a controller configured to detect whether the removable feeding unit has been replaced based on a signal output from the detector, wherein when the removable feeding unit with the holding member in the holding position is mounted to the driving unit, the supporting part is in contact with the detected part so that the detected part is in the first position, and wherein when the removable feeding unit is mounted to the driving unit and the feed roller is driven, the holding member retracts from the holding position to the retracted position so that the supporting part separates from the detected part and the detected part retracts from the first position to the second position.

12. A sheet feeding apparatus comprising:

a removable stacking unit including a lifting member in which a sheet-shaped recording material is stacked;

a sheet feeding part detector configured to detect a state indicating whether the stacking unit is mounted or removed;

a recording material detector configured to detect the recording material stacked in the stacking unit;

a detected part configured to be movable between a first position and a second position;

a sheet surface detector configured to output:

a first signal when the detected part is in the first position; and a second signal when the detected part is in the second position, wherein in a state where the recording material is stacked on the lifting member and the lifting member is lifted, the detected part is in a position where the sheet surface detector outputs the first signal;

a feeding unit configured to be mountable to and removable from a main body of the sheet feeding apparatus, the feeding unit including:

a feed roller that conveys the recording material; and a holding member including a supporting part and configured to be movable between a holding position and a retracted position; and a controller configured to detect that the feeding unit has been replaced based on history information indicating mounting and removal of the stacking unit detected by the sheet feeding part detector, when the sheet surface detector outputs the first signal and output of the recording material detector indicates that the recording material is not present, wherein when the feeding unit with the holding member in the holding position is mounted to the main body, the supporting part is in contact with the detected part so that the detected part is in the first position, and wherein when the feeding unit is mounted to the main body and the feed roller is driven, the holding member retracts from the holding position to the retracted position so that the supporting part separates from the detected part and the detected part retracts from the first position to the second position.

13. The sheet feeding apparatus according to claim 12, wherein the controller is configured to determine that:

the feeding unit has been replaced when the history information is stored; and the recording material is not present when the history information is not stored.

14. The sheet feeding apparatus according to claim 13, wherein the controller is configured to:

switch the detected part to the first position using the holding member when the feeding unit is determined to have been replaced; and determine that the feeding unit has malfunctioned when the sheet surface detector cannot detect the recording material as being at a height at which the recording material is conveyable.

15. The sheet feeding apparatus according to claim 12, wherein:

the history information is stored when the sheet feeding part detector detects that the stacking unit has been removed, and the history information is cleared after being referenced for the purpose of detecting that the feeding unit has been replaced.

16. The sheet feeding apparatus according to claim 15, wherein the history information is further cleared when:

the sheet surface detector detects that the recording material is not at a height at which the recording material is conveyable, or the recording material detector detects that the recording material is present.

17. The sheet feeding apparatus according to claim 12, wherein the controller is configured to output a message prompting a user to mount or remove the stacking unit after the sheet feeding apparatus is powered on.

18. The sheet feeding apparatus according to claim 12, wherein the controller is configured to reset a counter for estimating a replacement timing of the feeding unit when the feeding unit is detected to have been replaced.

19. An image forming apparatus comprising:

the sheet feeding apparatus according to claim 17; and an image forming unit that forms an image on the recording material fed by the sheet feeding apparatus.

20. A sheet feeding apparatus comprising:

a removable stacking unit including a lifting member in which a sheet-shaped recording material is stacked;

a recording material detector configured to detect the recording material stacked in the stacking unit;

a detected part configured to be movable between a first position and a second position;

a sheet surface detector configured to output:

a first signal when the detected part is in the first position; and a second signal when the detected part is in the second position, wherein in a state where the recording material is stacked on the lifting member and the lifting member is lifted, the detected part is in a position where the sheet surface detector outputs the first signal;

a feeding unit configured to be mountable to and removable from a main body of the sheet feeding apparatus, the feeding unit including:

a feed roller that conveys the recording material; and a holding member including a supporting part and configured to be movable between a holding position and a retracted position; and a controller configured to:

drive the feed roller and switch the detected part to the second position in response to a conveyance instruction, when the sheet surface detector outputs the first signal and the recording material detector detects that the recording material is present; and then after the sheet surface detector outputs the second signal, determine that the feeding unit has been replaced, wherein when the feeding unit with the holding member in the holding position is mounted to the main body, the supporting part is in contact with the detected part so that the detected part is in the first position, and wherein when the feeding unit is mounted to the main body and the feed roller is driven, the holding member retracts from the holding position to the retracted position so that the supporting part separates from the detected part and the detected part retracts from the first position to the second position.

21. The sheet feeding apparatus according to claim 20, wherein the controller is configured to:

drive the feed roller and switch the detected part to the first position; and then after the sheet surface detector outputs the first signal, determine that the recording material is jammed.

22. A sheet feeding apparatus comprising:

a removable stacking unit including a lifting member in which a sheet-shaped recording material is stacked;

a sheet feeding detector configured to detect a state indicating whether the stacking unit is mounted or removed;

a recording material detector configured to detect the recording material stacked in the stacking unit;

a detected part configured to be movable between a first position and a second position;

a sheet surface detector configured to output:

a first signal when the detected part is in the first position; and a second signal when the detected part is in the second position, wherein in a state where the recording material is stacked on the lifting member and the lifting member is lifted, the detected part is in a position where the sheet surface detector outputs the first signal;

a feeding unit configured to be mountable to and removable from a main body of the sheet feeding apparatus, the feeding unit including:

a feed roller that conveys the recording material; and a holding member including a supporting part and configured to be movable between a holding position and a retracted position; and a controller configured to:

when the sheet feeding part detector detects that the stacking unit has been removed, start measuring a time in response to a signal output from the sheet surface detector changing from the second signal to the first signal;

stop measuring the time in response to the recording material detector detecting that a state in which the recording material is not present has changed to a state in which the recording material is present; and determine that the feeding unit has been replaced when the measured time is not less than or equal to a threshold time, wherein when the feeding unit with the holding member in the holding position is mounted to the main body, the supporting part is in contact with the detected part so that the detected part is in the first position, and wherein when the feeding unit is mounted to the main body and the feed roller is driven, the holding member retracts from the holding position to the retracted position so that the supporting part separates from the detected part and the detected part retracts from the first position to the second position.

23. The sheet feeding apparatus according to claim 22, wherein the controller is configured to determine that the recording material stacked in the stacking unit is in an overloaded state when the measured time is less than or equal to the threshold time.

* * * * *